US008353508B2

(12) United States Patent
Nishikata et al.

(10) Patent No.: US 8,353,508 B2
(45) Date of Patent: Jan. 15, 2013

(54) IMAGE FORMING APPARATUS

(75) Inventors: Kazushi Nishikata, Odawara (JP); Shinichi Ueda, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 79 days.

(21) Appl. No.: 12/835,915

(22) Filed: Jul. 14, 2010

(65) Prior Publication Data

US 2011/0024978 A1 Feb. 3, 2011

(30) Foreign Application Priority Data

Jul. 31, 2009 (JP) ..... 2009-179911

(51) Int. Cl.
*B65H 1/10* (2006.01)
*B65H 1/08* (2006.01)

(52) U.S. Cl. ..... 271/160; 271/147

(58) Field of Classification Search ..... 271/145, 271/156, 157, 160, 126, 127, 171
See application file for complete search history.

(56) References Cited

U.S. PATENT DOCUMENTS 4,623,137 A * 11/1986 Irie et al. ..... 271/160
5,823,525 A * 10/1998 Miki ..... 271/127
5,954,327 A * 9/1999 Lin et al. ..... 271/110
5,963,755 A 10/1999 Ueda et al.
6,149,147 A * 11/2000 Hur et al. ..... 271/160
6,877,742 B2 4/2005 Nishikata et al.
7,032,900 B2 4/2006 Nishikata et al.
7,681,878 B2 * 3/2010 Youn ..... 271/160
7,758,042 B2 * 7/2010 Tomura et al. ..... 271/162
2007/0182088 A1 * 8/2007 Tomura et al. ..... 271/157
2009/0166966 A1 7/2009 Nishikata et al.

FOREIGN PATENT DOCUMENTS

JP 2006-056685 3/2006

* cited by examiner

*Primary Examiner* — Patrick Cicchino
(74) *Attorney, Agent, or Firm* — Fitzpatrick, Cella, Harper & Scinto

(57) ABSTRACT

Provided is an image forming apparatus, which includes: a pressing lever and a pressing arm for pushing up a sheet stacking plate so that sheets stacked on the sheet stacking plate are brought into pressure contact with a sheet feeding portion; a lifter driving mechanism for driving the pressing lever and the pressing arm; and a setting mechanism disposed between the pressing lever and the pressing arm, and the lifter driving mechanism. The setting mechanism is capable of setting a pressure contact force for bringing the sheets stacked on the sheet stacking plate into pressure contact with the sheet feeding portion, to be appropriate for a size of the sheets to be stacked and an amount of the sheets to be stacked.

4 Claims, 23 Drawing Sheets

IMAGE FORMING APPARATUS

BACKGROUND OF THE INVENTION

1. Field of the Invention

The present invention relates to an image forming apparatus, and more particularly, to an image forming apparatus capable of changing, depending on a size of sheets, a pressure contact force for bringing the sheets into pressure contact with a sheet feeding roller.

2. Description of the Related Art

A conventional image forming apparatus, such as a copying machine, a laser beam printer (LBP), or a facsimile, includes a sheet feeder for feeding sheets one by one from a sheet feeding cassette storing multiple sheets. In general, the conventional image forming apparatus includes a sheet feeding cassette mountably installed in an apparatus main body, and a pickup roller for automatically feeding sheets stored in the sheet feeding cassette to an image forming portion. The sheet feeding cassette may be provided with an intermediate plate (sheet stacking plate) on which sheets are stacked. The intermediate plate is provided in a liftable manner. When the sheet feeding cassette is installed in a predetermined installation position in the image forming apparatus main body, the intermediate plate is pushed up by a lifter mechanism at the installation position to be rotated upward.

When the intermediate plate is rotated upward, the uppermost sheet of the sheets stacked on the intermediate plate is pressed against the pickup roller. The pickup roller is also moved up when the intermediate plate is further moved upward. After that, the intermediate plate is stopped when the pickup roller is moved up to a predetermined position. The intermediate plate stops at a position for applying an appropriate sheet feeding pressure on an upper surface of the sheets by the pickup roller when feeding the sheets. The intermediate plate is stopped at such a position, to thereby allow the sheets to be reliably fed. With this configuration, the uppermost sheet is always pressed against the pickup roller to be fed even in a case where the number of sheets is small.

FIG. 21 is a diagram for illustrating an example of the conventional lifter driving mechanism described above. In FIG. 21, a sheet feeding cassette 110 may be mountably installed in an apparatus main body. The sheet feeding cassette 110 is provided with a sheet stacking plate 111 on which sheets S are stacked. The sheet stacking plate 111 is provided as being rotatable in a vertical direction. Provided below the sheet stacking plate 111 is a pressing lever 112 serving as a lift member for pushing up the sheet stacking plate 111 toward a sheet feeding roller 102. The pressing lever 112 is coupled to a pressing arm 113 at the back of the apparatus main body, and connected to a lifter rack 115 via a pressure spring 114 serving as a helical extension spring. A cassette gear 116 is provided inside the sheet feeding cassette 110, and functions as a pinion gear for the lifter rack 115. A driving force transmission gear 104 is provided to the apparatus main body, and serves as a driving unit for driving the pressing lever 112. The driving force transmission gear 104 receives a driving force transmitted by a motor (not shown), to thereby transmit the driving force to the cassette gear 116.

In the sheet feeding apparatus configured as described above, when the sheet feeding cassette 110 is installed in the apparatus main body, the cassette gear 116 provided to the sheet feeding cassette 110 is engaged with the driving force transmission gear 104 provided to the apparatus main body. When a detecting unit (not shown) detects that the sheet feeding cassette 110 is installed, the motor (not shown) is driven. Along with the driving of the motor, the driving force transmission gear 104 is rotated, and the lifter rack 115 starts to move in a direction indicated by the arrow P via the cassette gear 116. As a result, the sheet stacking plate 111 is moved up via the pressure spring 114 coupled to the lifter rack 115, the pressing arm 113, and the pressing lever 112, and the sheets S on the sheet stacking plate 111 are brought into pressure contact with the sheet feeding roller 102. After that, the motor (not shown) is stopped after being rotated for a predetermined number of times. At this time, the pressure spring 114 serves as a pressing unit for applying a sheet feeding pressure to the sheet feeding roller 102 and the sheet S.

After that, when the sheets S are sequentially fed and the number of sheets S on the sheet stacking plate 111 decreases, the pressing arm 113 and the pressing lever 112 are turned in a CCW direction by the pressure spring 114, so as to push up the sheet stacking plate 111. During the sheet feeding operation, the position of the lifter rack 115 is fixed, and hence the acting length of the pressure spring 114 is reduced when the pressing arm 113 is turned by an increased amount as the number of sheets on the sheet stacking plate 111 decreases. At this time, a rate of decrease in weight of the sheets S on the sheet stacking plate 111 and the spring force of the pressure spring 114 which is reduced in acting length may be balanced, to thereby apply a constant sheet feeding pressure regardless of the varying amount of stacked sheets. As a result, double feeding which is likely to occur when the sheet feeding pressure is too high or nonfeeding which is likely to occur when the sheet feeding pressure is too low may be prevented, to thereby attain stable sheet feeding performance regardless of the varying amount of stacked sheets.

An apparatus provided with the lifter driving mechanism which moves up the sheet stacking plate by the pressing lever turned by the motor as described above is known to excel in operability when attaching and detaching the sheet feeding cassette. For example, conventionally, there is an image forming apparatus with a configuration in which a pressing force to be applied to the sheet stacking plate is generated as the sheet feeding cassette is pushed into the image forming apparatus main body. With this configuration, the sheet feeding cassette needs to be pushed against the pressing force to be installed, which leads to a problem that a larger resistance force is generated when installing the sheet feeding cassette which has a larger number of sheets stacked on the sheet stacking plate. In particular, in the case of an image forming apparatus in which the sheet feeding cassette is installed and detached in a direction orthogonal to a sheet feeding direction, the sheet feeding cassette has an asymmetric structure in which a sheet supplying portion is disposed on one of the right side and the left side of the sheet feeding cassette. As a result, the resistance forces on the right and the left of the sheet feeding cassette are different from each other, which makes the installation and detachment of the sheet feeding cassette even more difficult.

According to the lifter driving mechanism, the pressing force is exerted by pushing up the sheet stacking plate after the sheet feeding cassette is installed in the image forming apparatus main body. Accordingly, there is no resistance force generated when installing the sheet feeding cassette, and hence the sheet feeding cassette may be installed smoothly. Even in the case of the image forming apparatus in which the sheet feeding cassette is installed and detached in a direction orthogonal to the sheet feeding direction, the sheet feeding cassette may be installed and detached smoothly without no one-sided resistance force to be generated. Japanese Patent Application Laid-Open No. 2006-56685 discloses a sheet feeder provided with the above-mentioned lifter driving mechanism, which includes a sheet feeding pressure control unit for controlling the sheet feeding pressure according to the sheet size. For example, the sheet feeder illustrated in FIG. 21 is provided with a sheet feeding pressure control unit, in which an amount of displacement of the lifter rack 115 is changed depending on the sheet size so that the acting length of the pressure spring 114 is changed, to thereby control the sheet feeding pressure. Due to the sheet feeding pressure control unit thus provided, a substantially constant sheet feeding pressure may be applied even in a case where the weight of sheets varies depending on the sheet size, to thereby attain stable sheet feeding performance without causing double feeding and nonfeeding.

The conventional image forming apparatus including the sheet feeding pressure control unit as described above employs a single elastic member (pressure spring) as the pressing unit, in which the sheet feeding pressure is controlled by changing the acting length of the elastic member. However, the sheet feeding pressure control unit provided with a single elastic member is incapable of controlling a sheet feeding pressure according to, for example, the sheet size or the amount of the stacked sheets in order to maintain the constant sheet feeding pressure constant. FIG. 22A is a graph illustrating the weights of small-size sheets and large-size sheets applied onto the sheet stacking plate in relation to the number of stacked sheets. The graph assumes a case of employing portrait A4-size sheets and portrait A5-size sheets, which are commonly-used standard-size sheets, and the line L1 indicates a case of the portrait A4-size sheets while the line L2 indicates a case of the portrait A5-size sheets. FIG. 22B is a graph illustrating a relation between the number of stacked sheets and the sheet feeding pressure when the spring pressure (elastic force) of the elastic member is set so that a constant sheet feeding pressure may be applied regardless of the number of large-size sheets stacked on the sheet stacking plate. According to the graph of FIG. 22B, a sheet feeding pressure N1 is applied for large-size sheets while a sheet feeding pressure N2 is applied for small-size sheets. As illustrated in the graph, when the sheet feeding pressure N1 for large-size sheets remains constant, the sheet feeding pressure N2 for small-size sheets are high when the sheets are full-stacked.

Conventionally, the acting length of the elastic member is configured to be variable so that the acting length may be adjusted to be reduced when feeding small-size sheets, to thereby keep the sheet feeding pressure low for the small-size sheets. However, the sheet feeding pressure is exerted by only one elastic member, and hence the spring constant is always the same. Accordingly, even when the acting length is adjusted to be small, a rate of increase (gradient in the graph) in the sheet feeding pressure with respect to the number of stacked sheets is constant as indicated by the broken line N3 of FIG. 22B, and hence the sheet feeding pressure N3 may only be controlled to be in parallel with the sheet feeding pressure N2 in the graph. The sheet feeding pressure may not remain constant for small-size sheets from a less-stacked state to a full-stacked state.

When a single elastic member is employed as the pressing unit, a predetermined sheet feeding pressure fails to be exerted, causing the sheet feeding pressure to start dropping from a half-stacked state to a full-stacked state as indicated by N4 of FIG. 23. The loss in the sheet feeding pressure is ascribable to the sliding resistance of the sheet bundle on the sheet stacking plate against the regulating surface of the sheet feeding cassette and against the side regulating member, and to a reaction force generated by the stiffness of the sheet bundle. The loss in the sheet feeding pressure is more likely to be generated in the case where large-size sheets or elongated sheets are employed, and also becomes significant when the amount of stacked sheets becomes large. For example, when a setting is made so that a sufficient sheet feeding pressure may be exerted even in the full-stacked state of sheets which exhibits a high pressure loss, an excessive sheet feeding pressure is exerted in the less-stacked state as indicated by N5 of FIG. 23. In view of this, the acting length of the elastic member may be varied from the half-stacked state to the full-stacked state. In this case, however, the amount of stacked sheets needs to be detected to control, which scales up the apparatus.

SUMMARY OF THE INVENTION

The present invention has been made in view of the above-mentioned circumstances, and the present invention provides an image forming apparatus capable of feeding sheets in a stable manner regardless of sheet size.

According to the present invention, there is provided an image forming apparatus including a sheet feeding cassette which is provided to an apparatus main body and provided with a sheet stacking portion configured to stack sheets thereon, the sheet stacking portion being liftable for a cassette main body, and a sheet feeding portion configured to feed the sheets to be stacked, the image forming apparatus including: a lift member configured to push up the sheet stacking portion so that the sheets to be stacked are brought into pressure contact with the sheet feeding portion; a plurality of elastic members coupled to the lift member; a driving mechanism configured to drive the lift member; and a setting mechanism disposed between the lift member and the driving mechanism, and setting a pressure contact force for bringing the sheet to be stacked into pressure contact with the sheet feeding portion by selectively causing the plurality of elastic members to function with respect to the lift member.

Further features of the present invention will become apparent from the following description of exemplary embodiments with reference to the attached drawings.

DESCRIPTION OF THE EMBODIMENTS

Figure 1:
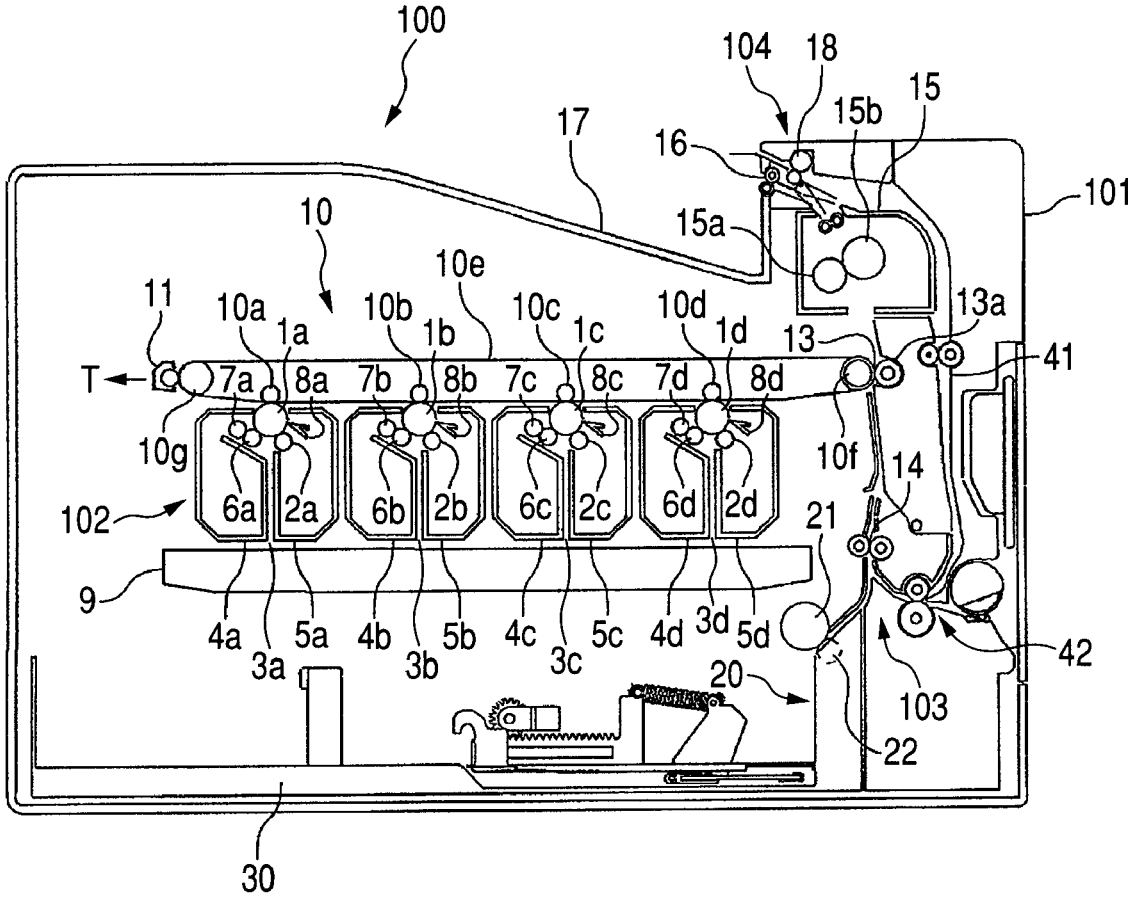
FIG. 1 is a diagram illustrating an entire configuration of a full color laser beam printer, which is an example of an image forming apparatus according to a first embodiment of the present invention.

In the following, embodiments for implementing the present invention are described in detail with reference to the accompanying drawings. FIG. 1 is a diagram illustrating an entire configuration of a full color laser beam printer 100, which is an example of an image forming apparatus according to a first embodiment of the present invention. In FIG. 1, a full color laser beam printer main body (hereinafter, referred to as printer main body) 101 is an apparatus main body of the full color laser beam printer 100. The printer main body 101 includes an image forming portion 102 for forming an image on a sheet and a sheet supplying portion 103 for feeding a sheet. The image forming portion 102 includes photosensitive drums 1*a* to 1*d*, which are image bearing members, and process cartridges 3*a* to 3*d* for forming toner images in four colors of yellow, magenta, cyan, and black. The process cartridges 3*a* to 3*d* are mountably installed in the printer main body 101. The image forming portion 102 includes a scanner unit 9 which is disposed vertically below the process cartridges 3*a* to 3*d*. The scanner unit 9 irradiates the photosensitive drums 1*a* to 1*d* with a laser beam based on image information, so that electrostatic latent images are formed on the photosensitive drums 1*a* to 1*d*. The process cartridges 3*a* to 3*d* each include developing units 4*a* to 4*d* and cleaner units 5*a* to 5*d*, respectively. The developing units 4*a* to 4*d*, for developing toner images by causing toners to adhere on to the electrostatic latent images each include developing rollers 6*a* to 6*d*, developer application rollers 7*a* to 7*d*, and toner containers, respectively. The cleaner units 5*a* to 5*d* each include the photosensitive drums 1*a* to 1*d*, charging rollers 2*a* to 2*d* for uniformly charging surfaces of the photosensitive drums 1*a* to 1*d*, drum cleaning blades 8*a* to 8*d*, and waste toner containers, respectively.

In FIG. 1, an intermediate transfer belt unit 10 includes an intermediate transfer belt 10*e* and primary transfer rollers 10*a* to 10*d* arranged inside the intermediate transfer belt 10*e*. The intermediate transfer belt 10*e* is looped around a drive roller 10*f* and a tension roller 10*g*. The primary transfer rollers 10*a* to 10*d* are arranged as being opposed to the photosensitive drums 1*a* to 1*d*, respectively, and are applied with a transfer bias by a bias applying unit (not shown). The primary transfer rollers 10*a* to 10*d* apply a primary transfer bias to the intermediate transfer belt 10*e*, so that the toner images in each color on the photosensitive drums 1*a* to 1*d* are sequentially transferred to the intermediate transfer belt 10*e*. As a result, a full-color image is formed on the intermediate transfer belt 10*e*. A secondary transfer portion 13 includes the drive roller 10*f* and a secondary transfer roller 13*a*, and sequentially transfers the full-color image formed on the intermediate transfer belt 10*e* to a sheet. A fixing portion 15 applies heat and pressure to the image formed on the sheet, to thereby fix the toner image onto the sheet. Inside the fixing portion 15, a heating roller 15*a* and a pressure roller 15*b* are provided. The heating roller 15*a* has a heater (not shown) incorporated thereinto, and the pressure roller 15*b* is in pressure contact with the heating roller 15*a*. A sheet delivery portion 104 delivers a sheet which has an image fixed thereonto in the fixing portion 15, to a sheet stacking portion 17, which is mountably attached to a top surface of the printer main body 101. The sheet delivery portion 104 includes a delivery roller pair 16 serving as a sheet delivery unit, a switchback roller pair 18, and a sheet surface reverse transport path 41.

The sheet supplying portion 103 includes a sheet feeder 20 and a manual feeder 42. The sheet feeder 20 includes a sheet feeding cassette 30 and a sheet feeding roller 21. The sheet feeding cassette is mountably installed in the printer main body 101. The sheet feeding roller 21 serves as a sheet feeding portion for feeding sheets stored in the sheet feeding cassette 30. In order to feed a sheet S stored in the sheet feeding cassette 30, the sheet feeding roller 21, which is in pressure contact with the sheet S, is rotated, to thereby send out the sheet S. The sheet S thus sent out is separately transported one by one through a separating portion including the sheet feeding roller 21 and a separating roller 22 which is in pressure contact with the sheet feeding roller 21, and then transported to a registration roller pair 14.

An image forming operation of the full color laser beam printer 100 is described. An image signal is input to the scanner unit 9 from a personal computer or the like (not shown), and the scanner unit 9 irradiates the photosensitive drums 1*a* to 1*d* with a laser beam corresponding to the image signal. At this time, the photosensitive drums 1*a* to 1*d* have surfaces uniformly charged in advance so as to be set to a predetermined polarity and a predetermined potential by the charging rollers 2*a* to 2*d*. Irradiated by the scanner unit 9 with the laser beam, the surfaces of the photosensitive drums 1*a* to 1*d* each have an electrostatic latent image formed thereon. After that, the electrostatic latent images are developed by the developing units 4*a* to 4*d*, to thereby visualize the images.

For example, the scanner unit 9 irradiates the photosensitive drum 1*a* with a laser beam based on an image signal of a yellow component of an original, so that an electrostatic latent image in yellow is formed on the photosensitive drum 1*a*. The electrostatic latent image in yellow is developed with a yellow toner supplied from the developing unit 4*a*, so that the image is visualized as a yellow toner image. After that, along with the rotation of the photosensitive drum 1*a*, the toner image is transported to a primary transfer portion where the photosensitive drum 1 and the intermediate transfer belt 10*e* abut on each other. Due to the primary transfer bias applied to the primary transfer roller 10*a*, the yellow toner image on the photosensitive drum 1*a* is transferred onto the intermediate transfer belt 10*e*. By the time a portion bearing the yellow toner image on the intermediate transfer belt 10*e* moves, a magenta toner image formed in a similar manner as described above on the photosensitive drum 1*b* is transferred onto the intermediate transfer belt 10*e* so as to be superposed on the yellow toner image. Similarly, along with the movement of the intermediate transfer belt 10*e*, a cyan toner image and a black toner image are each transferred in the primary transfer portion so as to be superposed on the yellow toner image and the magenta toner image. In this manner, a full-color toner image is formed on the intermediate transfer belt 10*e*.

In parallel with the toner image forming operation, in the case of cassette feeding, the sheet S stored in the sheet feeding cassette 30 is sent out by the sheet feeding roller 21 to be separated by the separating roller 22 and transported one by one. The separate sheet S is transported to the registration roller pair 14. The sheet S transported to the registration roller pair 14 is timed by the registration roller pair 14, and then transported to the secondary transfer portion 13. In the secondary transfer portion 13, the secondary transfer roller 13*a* is applied with a bias of positive polarity, so that the four-colored toner image on the intermediate transfer belt 10*e* is secondarily transferred to the sheet S thus transported.

The sheet S which has the toner image transferred thereonto is transported to the fixing portion 15, where the sheet S is applied with heat and pressure by the fixing roller 15*a* and the pressure roller 15*b*, so that the full-color toner image is fixed as a permanent image on the surface of the sheet S. After the full-color toner image is fixed as a permanent image, the sheet S is delivered by the delivery roller pair 16 provided to the sheet delivery portion 104 to be stacked on the sheet stacking portion 17. When forming an image on both side of the sheet S, the sheet S is transported by the reverse rotation of the switchback roller pair 18 to be guided through the sheet surface reverse transport path 41, so that the sheet S is returned to the registration roller pair 14. After that, the sheet S is transported to the secondary transfer portion 13 by the registration roller pair 14, and an image is formed on a secondary surface of the sheet S. The sheet S having an image formed on the secondary surface thereof passes through the fixing portion 15 so that the image is fixed, and then delivered by the delivery roller pair 16 to be stacked on the sheet stacking portion 17.

Figure 2:
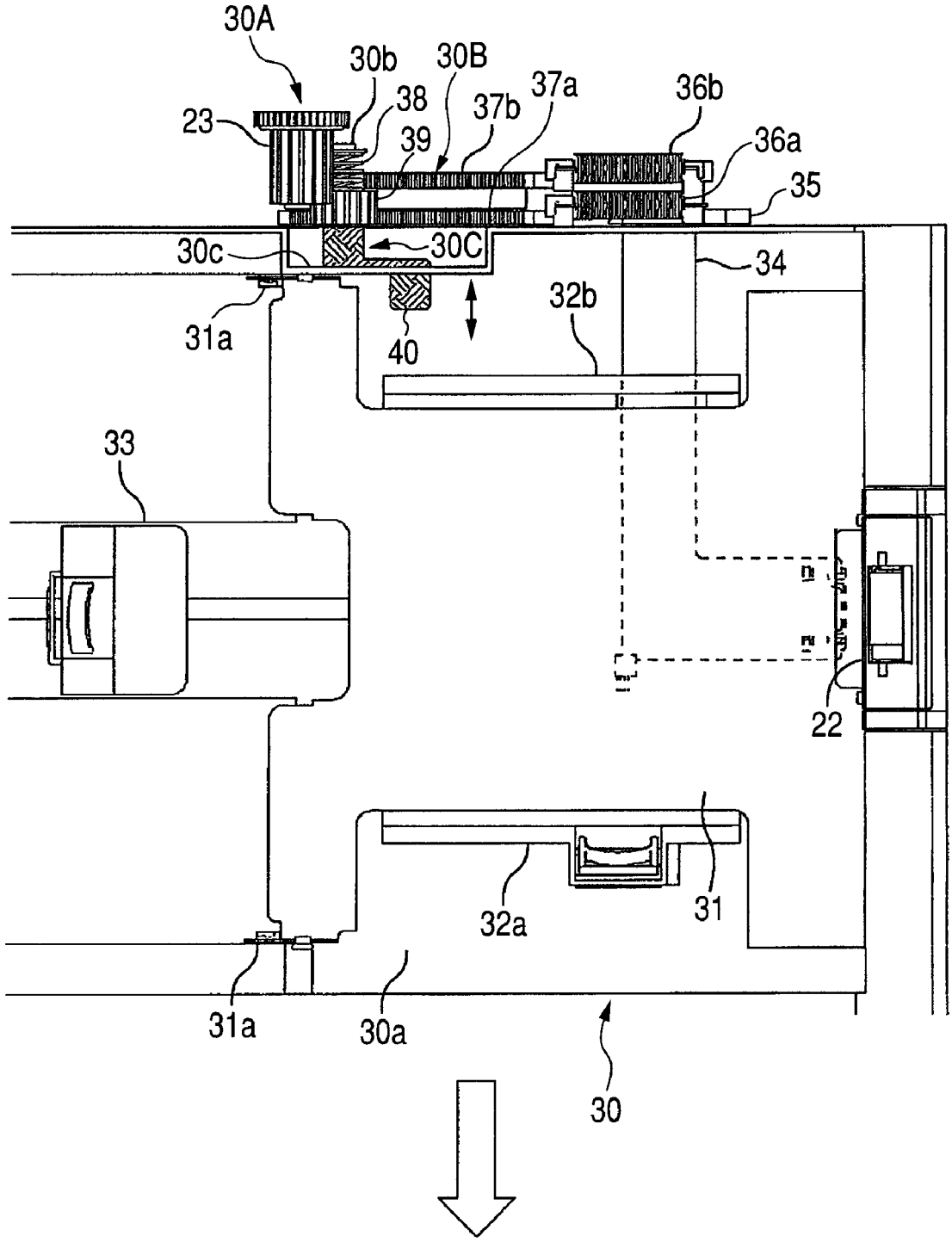
FIG. 2 is a top view of a sheet feeding cassette to be installed in the full color laser beam printer.

FIG. 2 is a top view of the sheet feeding cassette 30, illustrating a state where the sheet feeding cassette 30 is installed in the printer main body 101. The sheet feeding cassette 30 is capable of storing sheets in varying sizes from portrait A5-size up to portrait A4-size. The sheet feeding cassette 30 includes a cassette main body 30*a* for storing multiple sheets. The cassette main body 30*a* is provided with a sheet stacking plate 31 serving as a sheet stacking portion for stacking sheets thereon, which is configured to be rotatable (liftable) around a pivot 31*a*. The sheet feeding cassette 30 is provided with a front side regulating member 32*a* and a rear side regulating member 32*b* for regulating a position of sheets on the sheet stacking plate 31 in a width direction, which is orthogonal to a sheet feeding direction of the sheets. The front side regulating member 32*a* and the rear side regulating member 32*b* are configured to be movable in the width direction, according to the sheet size. The sheet feeding cassette 30 is provided with a trailing edge regulating member 33 for regulating a trailing edge of the sheets on the sheet stacking plate 31. The trailing edge corresponds to an edge located upstream side of the sheet transporting direction of the sheets. The trailing edge regulating member 33 is configured to be movable in the sheet transporting direction, according to the sheet size.

Provided below the sheet stacking plate 31 is a pressing lever 34 for pushing up the sheet stacking plate 31 toward the sheet feeding roller 21. The pressing lever is coupled to a pressing arm 35 at the back of the printer main body 101. The pressing arm 35 turns the pressing lever 34 in a vertical direction, so that the sheet stacking plate 31 is moved in a vertical direction. In this embodiment, the pressing lever 34 and the pressing arm 35 serve as a lift member. The lift member presses up the sheet stacking plate 31 so that the sheets stacked on the sheet stacking plate 31 are brought into pressure contact with the sheet feeding roller 21. The pressing arm 35 is driven by a lifter driving mechanism 30A serving as a driving mechanism. The lifter driving mechanism 30A is provided with a setting mechanism 30B. The setting mechanism 30B adjusts the pressure contact force for bringing sheets on the sheet stacking plate (sheet stacking portion) 31 into pressure contact with the sheet feeding roller 21 as appropriate according to the sheet size.

Figure 3:
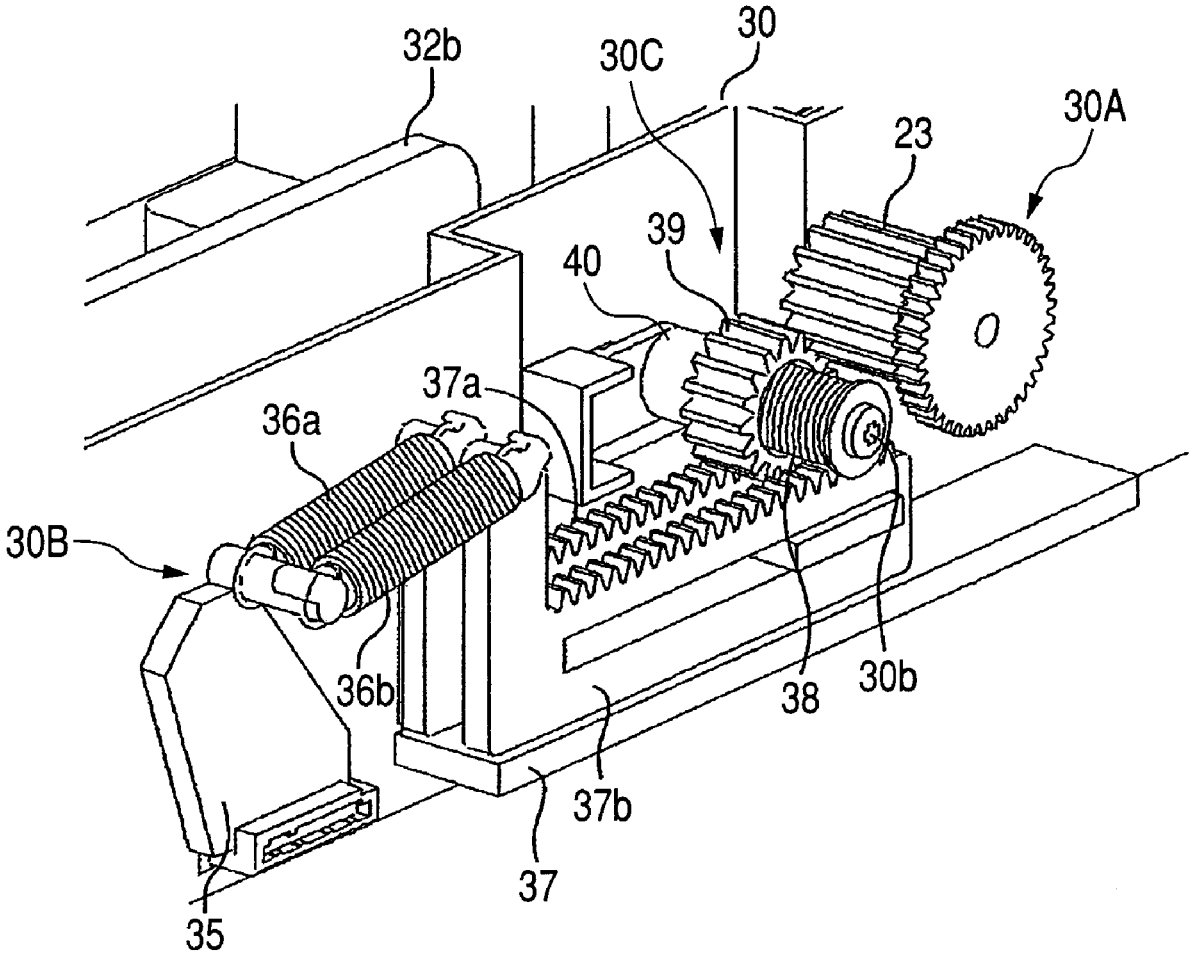
FIG. 3 is a diagram for illustrating configurations of a lifter driving mechanism for driving a pressing arm which moves up and down a sheet stacking plate provided to the sheet feeding cassette and a setting mechanism for switching between pressure springs.

The setting mechanism 30B includes multiple elastic members, as illustrated in FIG. 3, each being engaged at one end with the pressing arm 35. In this embodiment, the setting mechanism 30B includes two pressure springs, namely, a first pressure spring 36*a* and a second pressure spring 36*b*. The first pressure spring 36*a* and the second pressure spring 36*b* have different spring constants set thereto, and generate different spring pressures (elastic forces). Other ends of the first pressure spring 36*a* and the second pressure spring 36*b* are each engaged with a first lifter rack 37*a* and a second lifter rack 37*b*, respectively. The first lifter rack 37*a* and the second lifter rack 37*b* extend in the sheet feeding direction, and are movable in the sheet feeding direction. The first pressure spring 36*a* and the second pressure spring 36*b* and the first lifter rack 37*a* and the second lifter rack 37*b* bring sheets on the sheet stacking plate into pressure contact with the sheet feeding roller 21 via the pressing arm 35 and the pressing lever 34 with a pressure contact force appropriate for the sheet size.

In FIG. 3, a cassette gear 39 is provided to the sheet feeding cassette 30, and functions as a pinion gear of the first lifter rack 37*a* and the second lifter rack 37*b*. A shift lever 40 is provided to the sheet feeding cassette 30 so as to be movable in the width direction, and moves the cassette gear 39 according to a position regulated by the rear side regulating member 32*b* according to the sheet size. As illustrated in FIG. 2, a rotation axis 30*b* is formed at one end of the shift lever 40, the end protruding from the cassette main body 30*a*. The rotation axis 30*b* holds the cassette gear 39 in a rotatable manner. The rotation axis 30*b* is provided with a cassette gear spring 38 for biasing the cassette gear 39 in a direction to the inside of the cassette main body 30*a*. The shift lever 40 is applied with a spring pressure of the cassette gear spring 38 via the cassette gear 39. The cassette gear 39 and the shift lever 40 serve as pressure contact force switching portion 30C for generating a pressure contact force appropriate for the sheet size by selectively switching, according to the sheet size, between the first pressure spring 36*a* and the second pressure spring 36*b* to function. A driving force transmission gear 23 is provided to the printer main body 101 and engaged with the cassette gear 39. The driving force transmission gear 23 serves as a drive source of the lifter driving mechanism 30A. The driving force transmission gear 23 receives power supplied from a motor (not shown), and transmits a driving force to the cassette gear 39 engaged therewith. Hereinafter, the first pressure spring 36*a* or the second pressure spring 36*b* "functions" when the first pressure spring 36*a* or the second pressure spring 36*b* is extended to generate an elastic force, and the first pressure spring 36*a* or the second pressure spring 36*b* is in a "functioning state" when the first pressure spring 36*a* or the second pressure spring 36*b* is extended and is generating an elastic force.

Figure 4A:
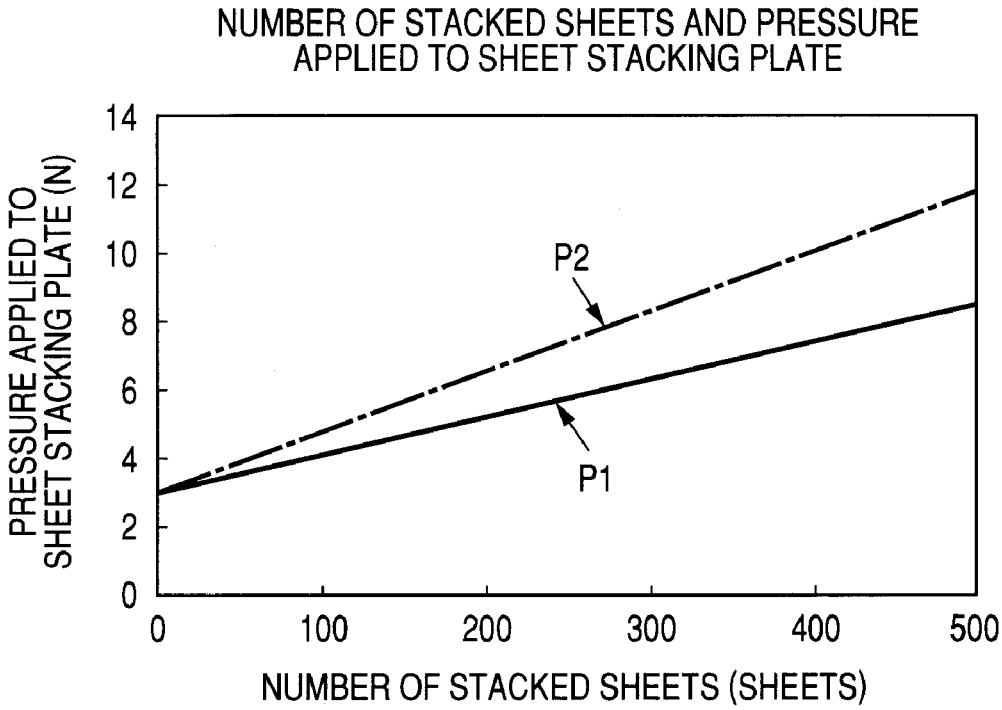
FIG. 4A is a graph illustrating a relation between the number of stacked sheets and a pressing force applied to a sheet stacking plate.
Figure 4B:
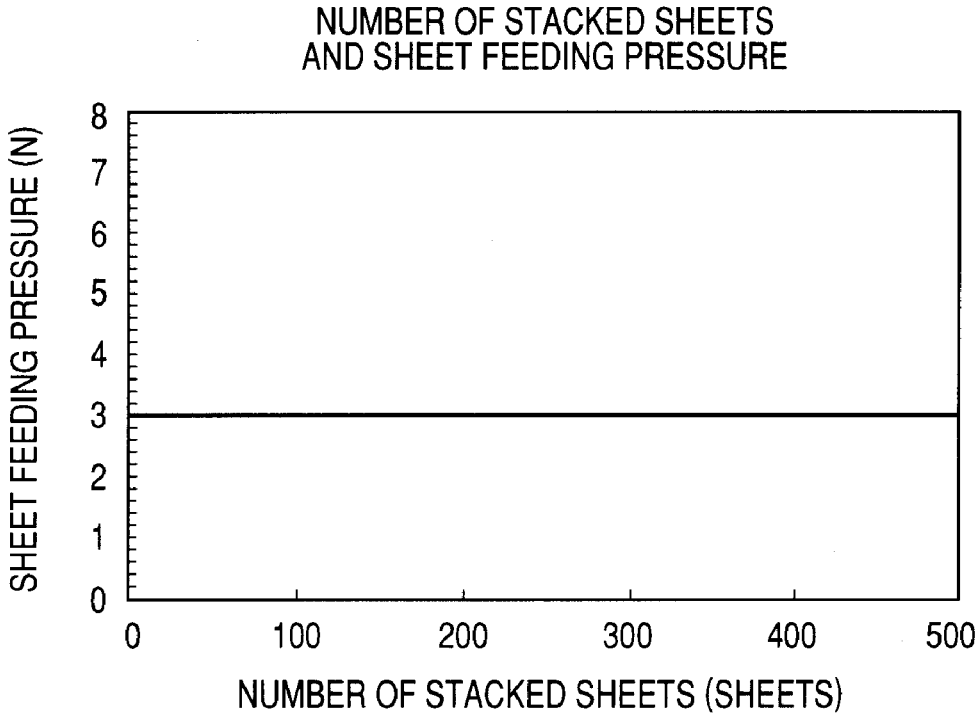
FIG. 4B is a graph illustrating a relation between the number of stacked sheets and a sheet feeding pressure.
Figure 22A:
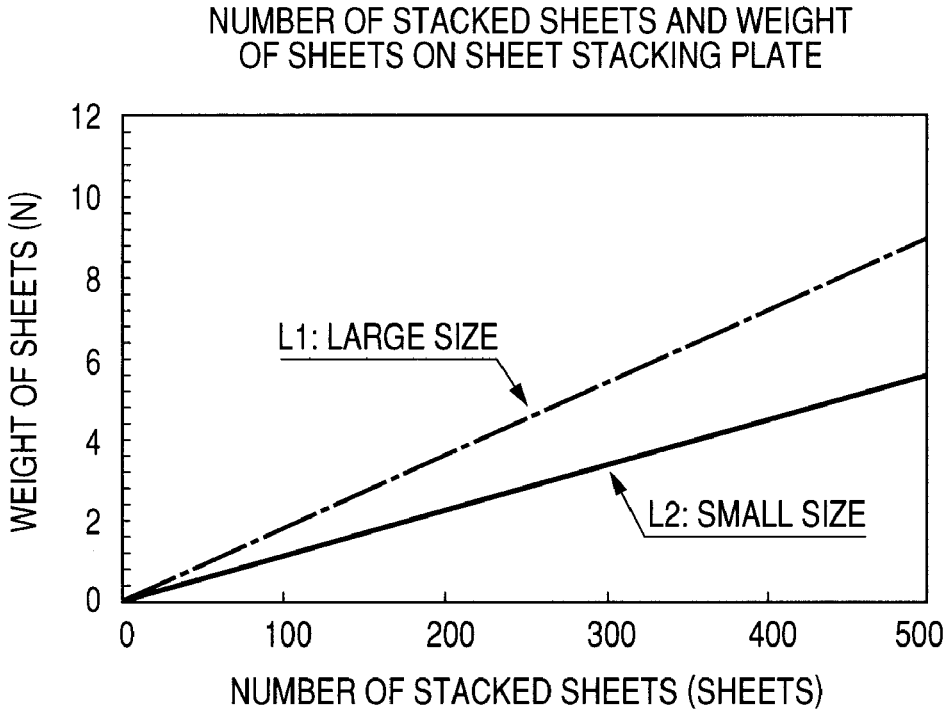
FIG. 22A is a graph illustrating a relation between the number of stacked sheets and weights of sheets on a sheet stacking plate.
Figure 22B:
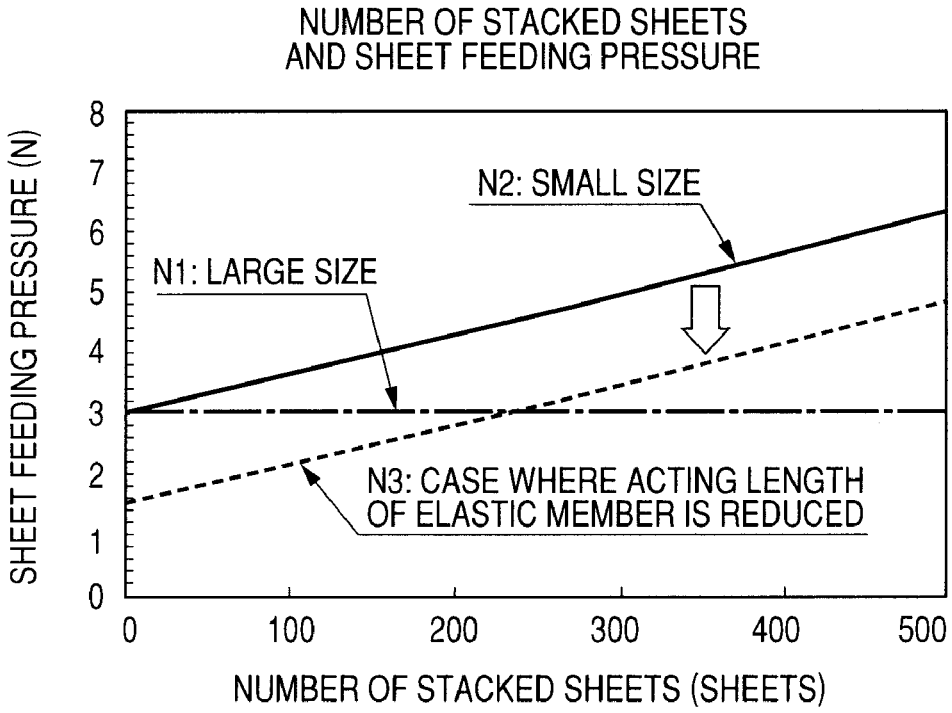
FIG. 22B is a graph illustrating a relation between the number of stacked sheets and a sheet feeding pressure.

A description is given of how to set the spring pressures (elastic forces) of the first pressure spring 36*a* and the second pressure spring 36*b*. A weight of sheets applied on the sheet stacking plate 31 is similar to that of FIG. 22A. A relation between a pressing force applied to the sheet stacking plate 31 due to the spring pressures of the first pressure spring 36*a* and the second pressure spring 36*b* and the number of stacked sheets is illustrated in FIG. 4A. FIG. 4A illustrates a pressing force P1 which is applied to the sheet stacking plate 31 when the first pressure spring 36*a* is in the functioning state, and a pressing force P2 which is applied to the sheet stacking plate 31 when the second pressure spring 36*b* is in the functioning state. As illustrated in FIG. 4A, the pressing force applied to the sheet stacking plate 31 increases as the number of stacked sheets increases. The rate of increase (gradient) is set to be different between the first pressure spring 36*a* and the second pressure spring 36*b*. The spring pressure (elastic force) of the first pressure spring 36*a* is set so that the pressing force P1 to be applied when the first pressure spring 36*a* functions is uniformly larger than the weight L2 for small-size sheets of FIG. 22A by 3N throughout the numbers of stacked sheets. Similarly, the spring pressure (elastic force) of the second pressure spring 36*b* is set so that the pressing force P2 to be applied when the second pressure spring 36*b* functions is uniformly larger than the weight L1 for large-size sheets of FIG. 22A by 3N throughout the numbers of stacked sheets. The sheet feeding pressure is obtained by subtracting the weight of the sheets on the sheet stacking plate 31 illustrated in FIG. 22A from the pressing force applied to the sheet stacking plate 31 illustrated in FIG. 4A. When making a setting for small-size sheets, the first pressure spring 36*a* may be placed in the functioning state, so that a constant sheet feeding pressure of 3N may be applied regardless of the number of stacked sheets. Similarly, when making a setting for large-size sheets, the second pressure spring 36*b* may be placed in the functioning state, so that a constant sheet feeding pressure of 3N may be applied regardless of the number of stacked sheets.

Figure 5A:
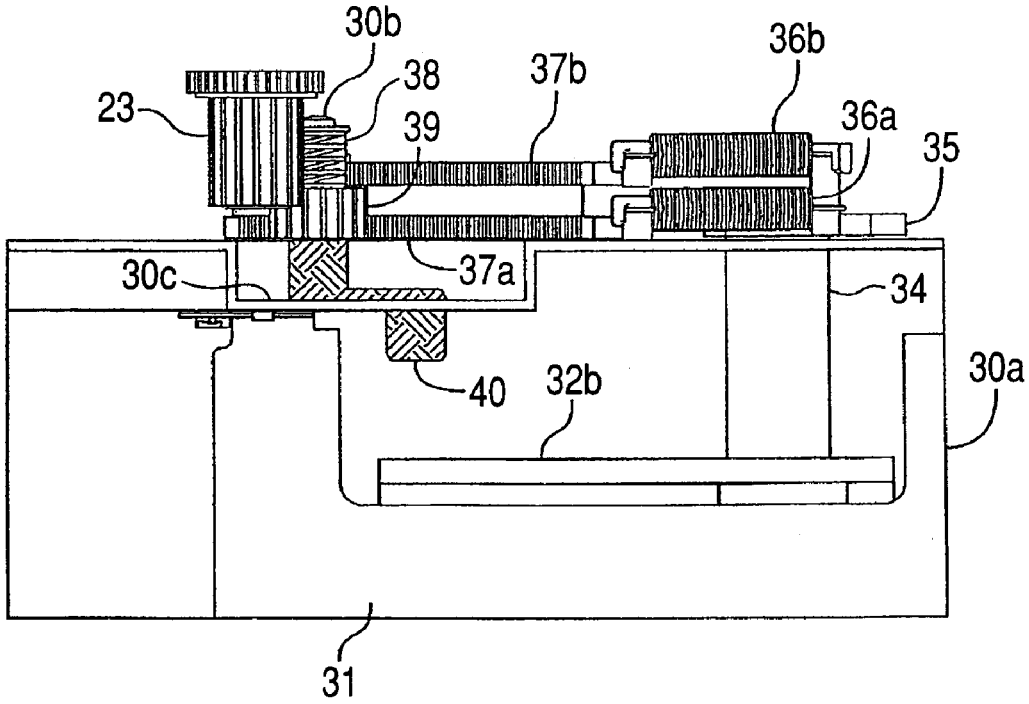
FIGS. 5A and 5B are first diagrams for illustrating a pressure spring switching operation of the setting mechanism and a lift-up operation of the lifter driving mechanism in a case where portrait A5-size sheets are stored in the sheet feeding cassette.
Figure 5B:
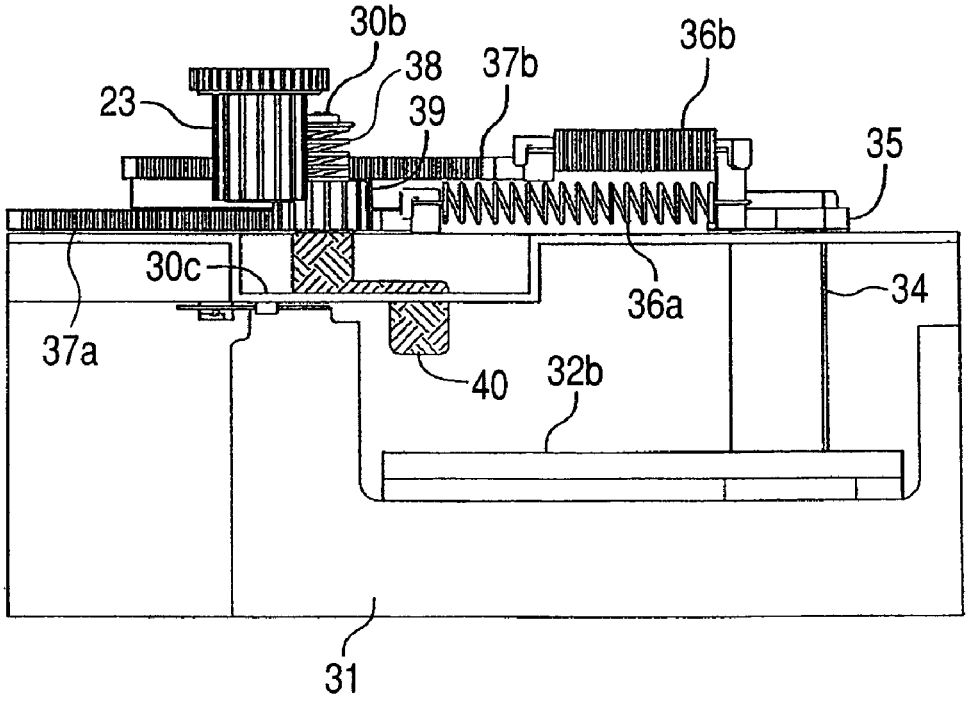

The switching operation of the setting mechanism 30B for selectively switching between the first pressure spring 36*a* and the second pressure spring 36*b* to function in association with a setting of sheet size, and an operation of the lifter driving function 30A (hereinafter, referred to as "lift-up operation") are described. FIGS. 5A and 5B are top views illustrating states of the sheet feeding cassette 30 when storing portrait A5-size sheets, which are small-size sheets. FIG. 5A illustrates a state before the lift-up operation, and FIG. 5B illustrates a state at the completion of the lift-up operation. When storing portrait A5-size sheets, a user slides the front side regulating member 32*a*, the rear side regulating member 32*b*, and the trailing edge regulating member 33, so that portrait A5-size sheets are set on the sheet stacking plate in the sheet feeding cassette 30. In this state, as illustrated in FIG. 5A, the cassette gear 39 and the shift lever 40 are biased by the cassette gear spring 38, and the shift lever 40 comes to abut on an abutment surface 30*c* formed on a side surface on the back side of the cassette main body 30*a* and stops. At this time, the cassette gear 39 is placed in a position to be engaged with the first lifter rack 37*a*, but not with the second lifter rack 37*b*.

Figure 6:
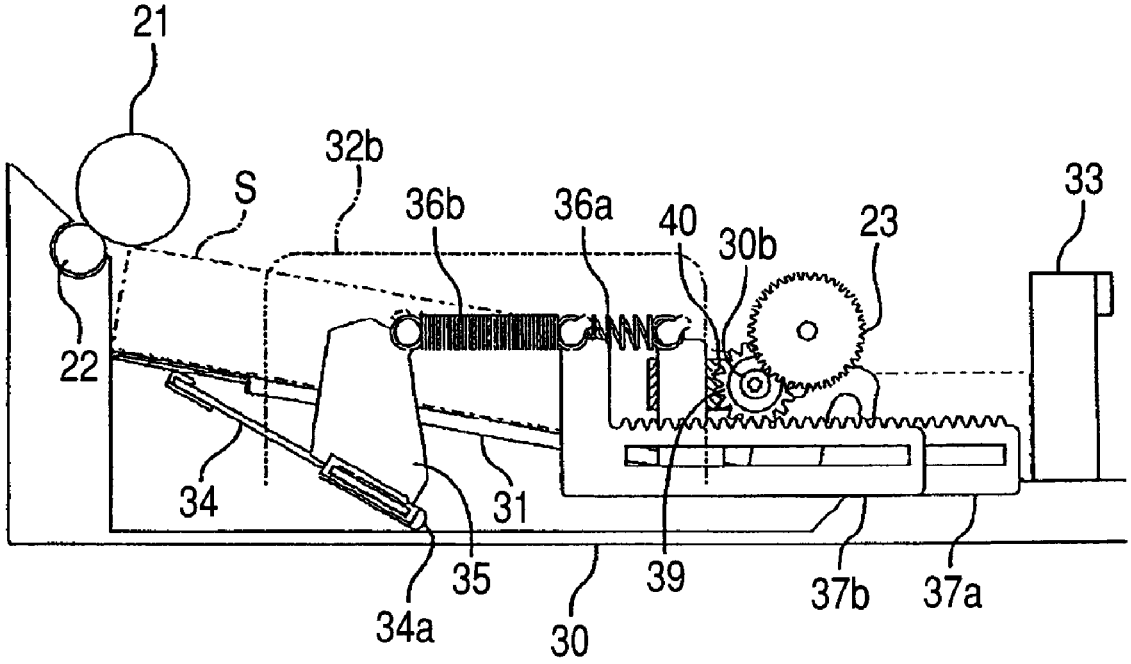
FIG. 6 is a second diagram for illustrating the pressure spring switching operation of the setting mechanism and the lift-up operation of the lifter driving mechanism.

When the sheet feeding cassette 30 is installed in the printer main body 101, the cassette gear 39 is meshed with the driving force transmission gear 23 as illustrated in FIG. 5A. When a detecting unit (not shown) detects that the sheet feeding cassette 30 is installed, a motor (not shown) is rotated. The driving force transmission gear 23 is rotated to transmit a driving force to the cassette gear 39, and the cassette gear 39 which has received the driving force moves only the first lifter rack 37*a* engaged with the cassette gear 39, to the left in the drawing along the sheet feeding direction. As a result, as illustrated in FIG. 5B, only the first pressure spring 36*a* is pulled and extended. When only the first pressure spring 36*a* is extended, as illustrated in FIG. 6, the pressing arm 35 turns in a clockwise direction, which causes the pressing lever 34 coupled to the pressing arm 35 to turn upward around the pivot 34*a* as a support. As a result, the sheet stacking plate 31 is pushed up from underneath by the pressing lever 34.

When the sheet stacking plate 31 is further moved upward after the sheets on the sheet stacking plate 31 are brought into abutment with the sheet feeding roller 21, the sheet feeding roller 21 is also moved upward. After that, the motor (not shown) is rotated a predetermined number of times so that the sheet feeding roller 21 is brought up to a predetermined position. When the sheets are brought into pressure contact with the sheet feeding roller 21 with a pressure contact force appropriate for the sheet size, the motor is stopped. In this embodiment, a sensor (not shown) is provided for detecting a position of the sheet feeding roller 21 which moves upward along with the upward movement of the sheet stacking plate 31. A control portion (not shown) stops the motor based on a detection signal from the sensor, to thereby retain the states illustrated in FIGS. 5B and 6. The control portion detects a full-stacked state, a half-stacked state, and a less-stacked state, based on a timing at which the detection signal from the sensor is input and a value of a counter counting the number of rotations (number of pulses) of the motor after the start of the lift-up operation. In this state, due to the spring pressure of the first pressure spring 36*a* in the functioning state, the pressing force P1 illustrated in FIG. 4A is applied to the sheet stacking plate 31 via the pressing arm 35 and the pressing lever 34. The sheet feeding pressure (pressure contact force) is obtained by subtracting the weight of the sheets (L2 of FIG. 22A) on the sheet stacking plate 31 from the pressing force P1. In this embodiment, the sheet feeding pressure is obtained as 3N. In other words, in the case of storing portrait A5-size sheets, that is small-size sheets, the first pressure spring 36*a* is caused to function, to thereby apply a constant sheet feeding pressure of 3N. When the sheet feeding roller 21 rotates with the sheet feeding pressure being applied thereto, a frictional force is generated between the uppermost sheet on the sheet stacking plate 31 and the sheet feeding roller 21, and the uppermost sheet is fed by the frictional force.

Figure 7A:
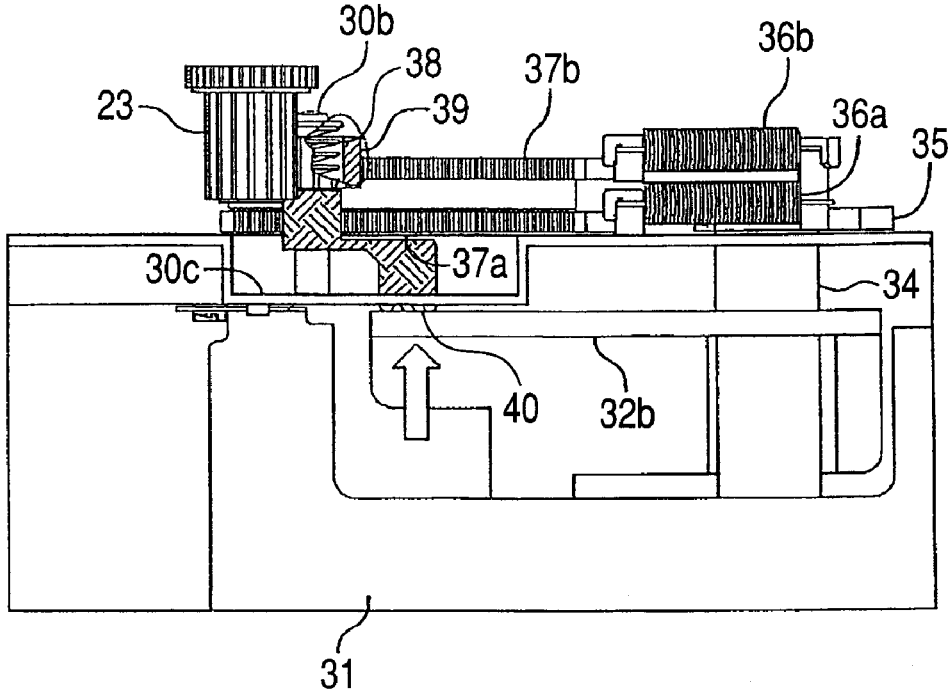
FIGS. 7A and 7B are diagrams for illustrating the pressure spring switching operation of the setting mechanism and the lift-up operation of the lifter driving mechanism in a case where portrait A4-size sheets are stored in the sheet feeding cassette.
Figure 7B:
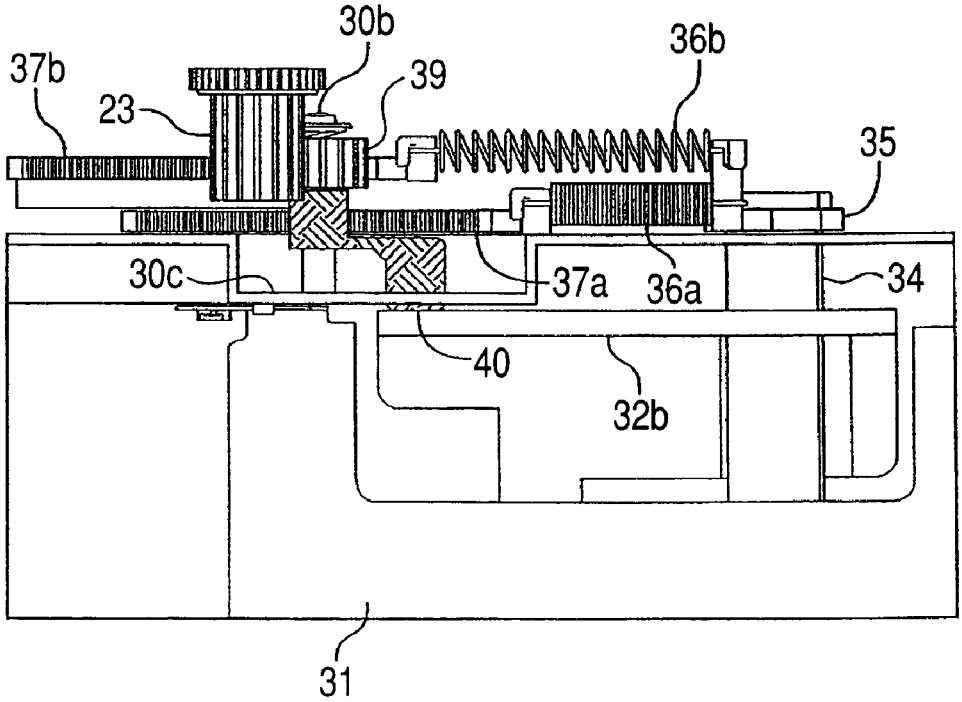

FIGS. 7A and 7B are top views illustrating states of the feeding cassette 30 when storing portrait A4-size sheets, which are large-size sheets. FIG. 7A illustrates a state before the lift-up operation, and FIG. 7B illustrates a state at the completion of the lift-up operation. When storing portrait A4-size sheets, the user slides the front side regulating member 32*a*, the rear side regulating member 32*b*, and the trailing edge regulating member 33, so that portrait A4-size sheets are set on the sheet stacking plate 31 in the sheet feeding cassette 30. When the rear side regulating member 32*b* is slid to be moved outward along the width direction, the rear side regulating member 32*b* pressurizes the shift lever 40, so that the shift lever 40 is also slid to be moved outside. Along with the movement, the cassette gear 39 also moves together with the shift lever 40. As a result, the cassette gear 39 is separated from the engagement position with the lifter rack 37*a* to be moved to the engagement position with the second lifter rack 37*b*. In this embodiment, according to the position of the rear side regulating member 32*b*, the cassette gear 39 is moved together with the shift lever 40, in a direction orthogonal to the moving direction of the first lifter rack 37*a* and the second lifter rack 37*b*, to thereby switch between the first lifter rack 37*a* and the second lifter rack 37*b* to be engaged with the cassette gear 39.

When the sheet feeding cassette 30 is installed in the printer main body 101 in a state where the cassette gear 39 is engaged with the second lifter rack 37*b*, the cassette gear 39 is meshed with the driving force transmission gear 23, as illustrated in FIG. 7A. When the installation of the sheet feeding cassette 30 is detected, the motor is rotated, to thereby rotate the driving force transmission gear 23. Due to the rotation of the driving force transmission gear 23, the cassette gear 39 rotates, so that only the second lifter rack 37*b* engaged with the cassette gear 39 is moved to the left in the drawing. As a result, as illustrated in FIG. 7B, only the second pressure spring 36*b* is pulled and extended, which causes the pressing arm 35 to turn in a clockwise direction. As a result, the sheet stacking plate 31 is pushed up from underneath by the pressing lever 34.

The sheets on the sheet stacking plate 31 abut on the sheet feeding roller 21. When the sheet is brought into pressure contact with the sheet feeding roller 21 with a pressure contact force appropriate for the sheet in portrait A4-size, the motor is stopped, to thereby retain the state illustrated in FIG. 7B. In this state, due to the spring pressure of the second pressure spring 36*b* in the functioning state, the pressing force P2 illustrated in FIG. 4A is applied to the sheet stacking plate 31 via the pressing arm 35 and the pressing lever 34. The sheet feeding pressure is obtained by subtracting the weight of the sheets (L1 of FIG. 22A) on the sheet stacking plate 31 from the pressing force P2. In this embodiment, the sheet feeding pressure is obtained as 3N. In other words, in the case of portrait A4-size sheets, that is storing large-size sheets, the second pressure spring 36*b* is caused to function, to thereby apply a constant sheet feeding pressure of 3N.

As described above, in this embodiment, the first pressure spring 36*a* and the second pressure spring 36*b* to be caused to function are automatically switched therebetween, depending on the position of the rear side regulating member 32*b*. The first pressure spring 36*a* and the second pressure spring 36*b* have different spring constants set thereto so as to have an appropriate spring constant according to the sheet size, and hence a substantially constant sheet feeding pressure may be applied regardless of the amount of stacked sheets. The first pressure spring 36*a* and the second pressure spring 36*b* to function with respect to the sheet stacking plate 31 are switched therebetween depending on the sheet size and the amount of stacked sheets, so that a substantially constant sheet feeding pressure may be applied regardless of the sheet size and the amount of stacked sheets, with the result that the sheets may be fed with stability. In other words, the first pressure spring 36*a* and the second pressure spring 36*b* to function are switched therebetween, depending on the sheet size and the amount of stacked sheets, to thereby attain stable sheet feeding performance without causing double feeding or nonfeeding, regardless of the sheet size and the amount of stacked sheets. In the above-mentioned description, the sheet size is switched between portrait A5-size and portrait A4-size. However, this embodiment may be applied to any sheets in arbitrary size, without being limited to portrait A5-size and portrait A4-size. In this embodiment, the sheet feeding cassette 30 supporting A4-size sheets is described, but the present invention is not limited thereto. The same effect may be obtained when this embodiment is applied to a large sheet feeding cassette such as A3-size.

Figure 8A:
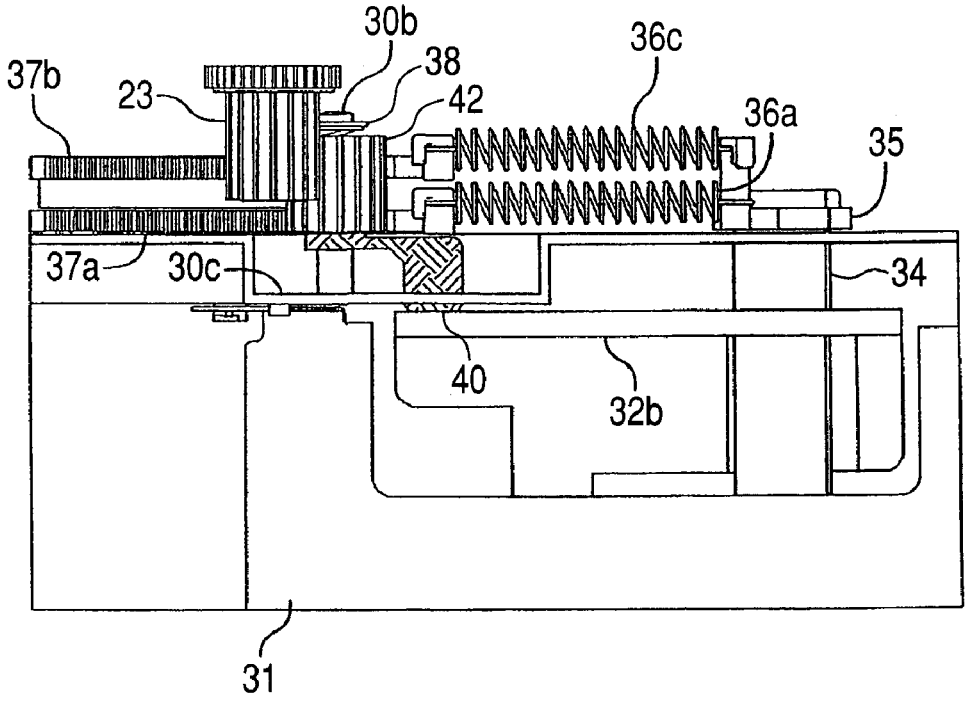
FIGS. 8A and 8B are diagrams for illustrating another configuration of the setting mechanism according to the first embodiment.

In the above-mentioned description, the cassette gear 39 is engaged with one of the first lifter rack 37*a* and the second lifter rack 37*b* according to the sheet size. However, this embodiment is not limited thereto. For example, as illustrated in FIG. 8A, a cassette gear 42 may be configured to have a thickness (length) which corresponds to the total thickness of two lifter racks, so that the cassette gear 42 may be engaged with both of the two lifter racks 37*a* and 37*b* simultaneously. In this case, the cassette gear 42 is engaged with the first lifter rack 37*a* when making a setting for small-size sheets, while the cassette gear 42 is engaged with the two lifter racks 37*a* and 37*b* as illustrated in FIG. 8A when making a setting for large-size sheets. In other words, when making a setting for large-size sheets, the two pressure springs 36*a* and 36*c* are caused to function, to thereby apply a pressing force to the sheet stacking plate 31. At this time, the total of the spring pressures of the two pressure springs 36*a* and 36*c* may be configured to be equal to the spring pressure of the second pressure spring 36*b*, to thereby obtain the same effect as described above.

Figure 8B:
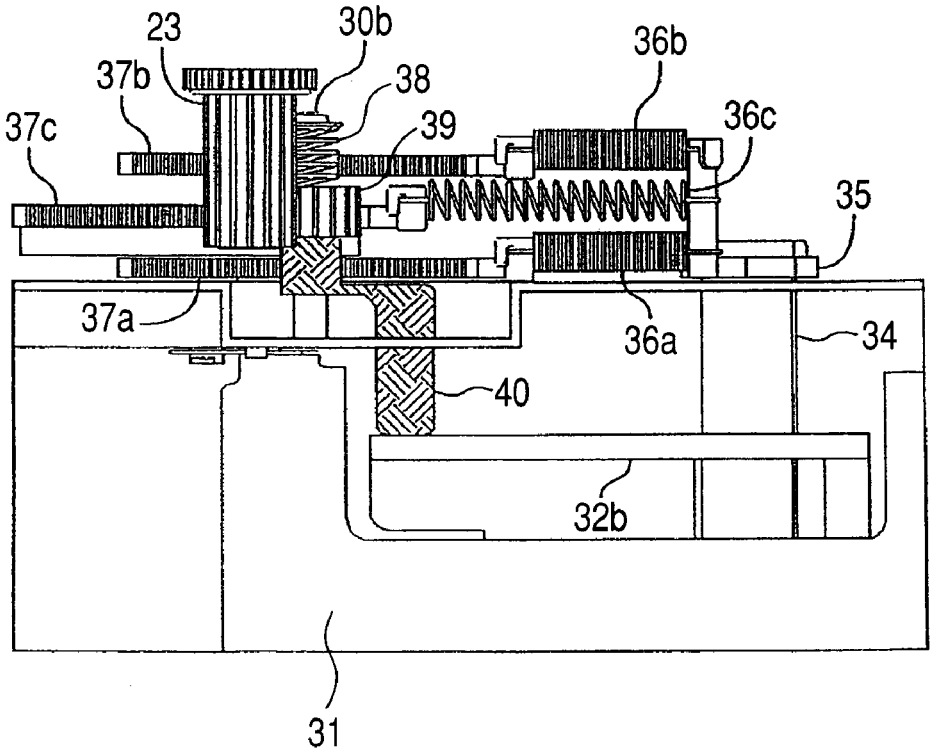

In the above, a description is given of the case where the two pressure springs and the two lifter racks are provided. However, as illustrated in FIG. 8B, for example, three pressure springs 36*a*, 36*b*, and 36*c*, and three lifter racks 37*a*, 37*b*, and 37*c* may be used. In this case, the pressing force to be applied to the sheet stacking plate 31 may be switched between three sheet sizes. In FIG. 8B, a third pressure spring 36*c* and a third lifter rack 37*c* are provided so as to suppose portrait B5-size, which is an intermediate size between portrait A4-size and portrait A5-size. The number of pressure springs and the lifter racks may be increased, so that the sheet feeding pressure may be set more minutely depending on the sheet size.

Figure 9A:
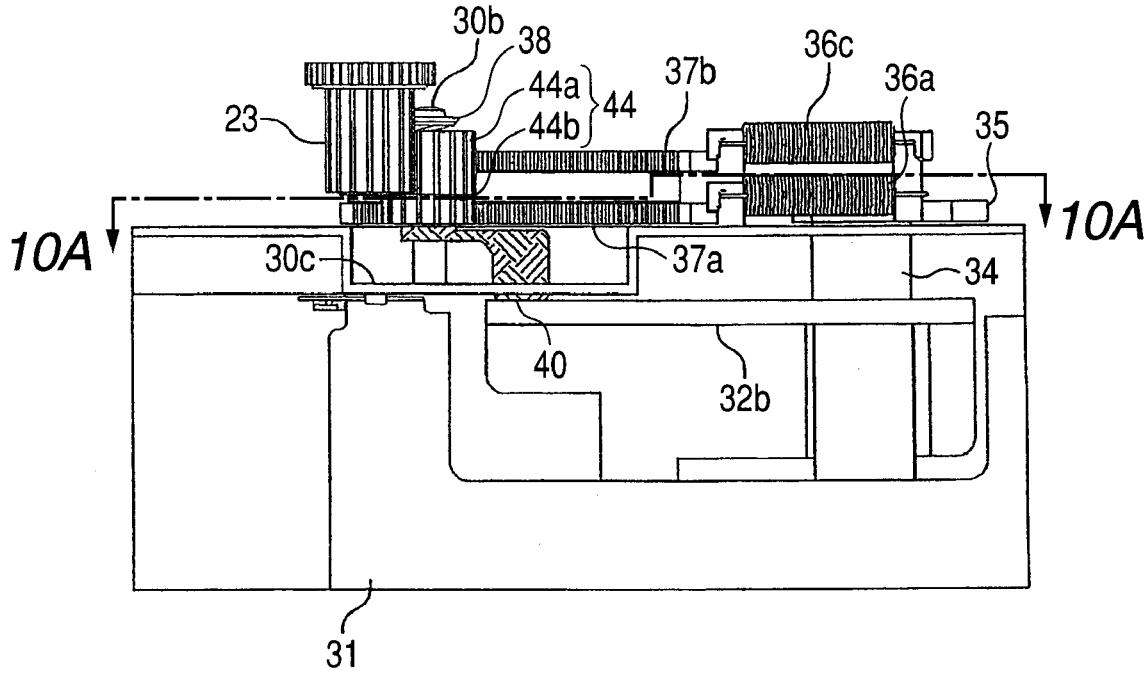
FIGS. 9A and 9B are diagrams for illustrating configurations of a lifter driving mechanism and a setting mechanism provided to an image forming apparatus according to a second embodiment of the present invention.
Figure 9B:
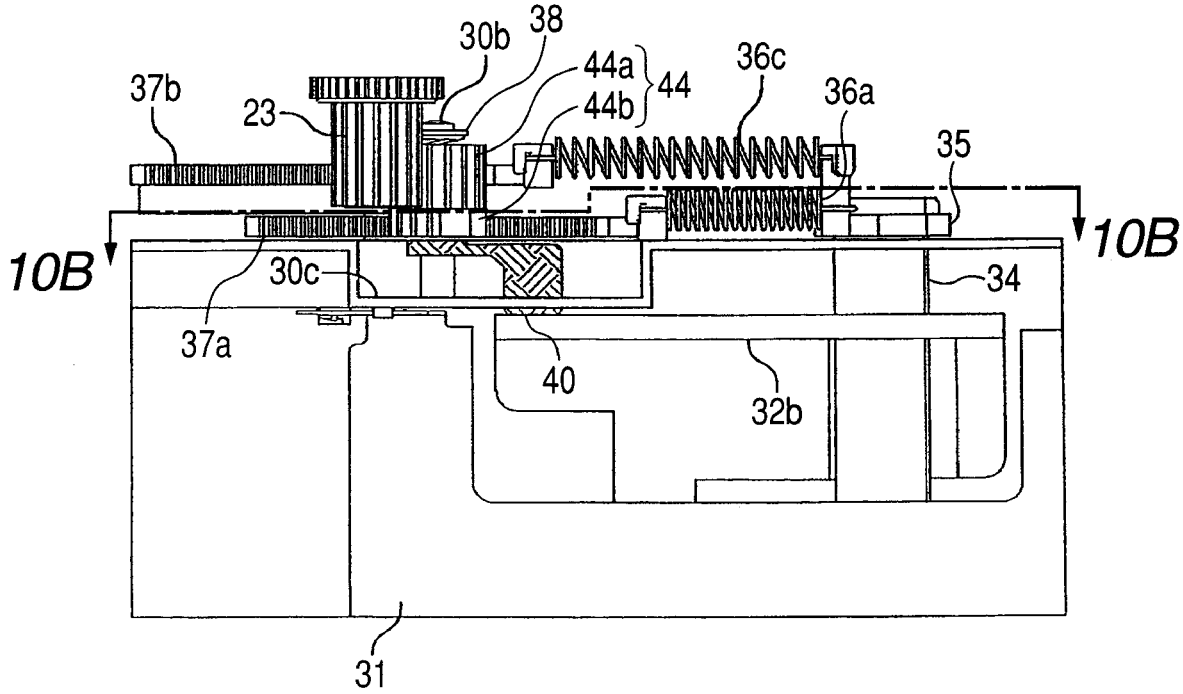

A second embodiment is described. FIGS. 9A and 9B are diagrams for illustrating a lifter driving mechanism and a setting mechanism provided to an image forming apparatus according the embodiment. In FIGS. 9A and 9B, portions being the same as or corresponding to those of FIGS. 5A and 5B are denoted by the same reference symbols. In FIGS. 9A and 9B, a cassette gear 44 has a thickness capable of engaging with the first lifter rack 37*a* and the second lifter rack 37*b* simultaneously. The cassette gear 44 has a spur gear portion 44*a* and a partially toothless gear portion 44*b* formed on a tip end portion and a base end portion in a thickness direction (axial direction), respectively. When making a setting for small-size sheets, similarly to the first embodiment, due to the function of the cassette gear spring 38, the cassette gear 44 and the shift lever 40 are moved, so that the spur gear portion 44*a* of the cassette gear 44 moves to a position of engaging with the first lifter rack 37*a*. When the lift-up operation is started from this sate, the operation and the pressing force to be applied to the sheet stacking plate 31 are similar to those of the first embodiment, and hence the description thereof is omitted.

Figure 10A:
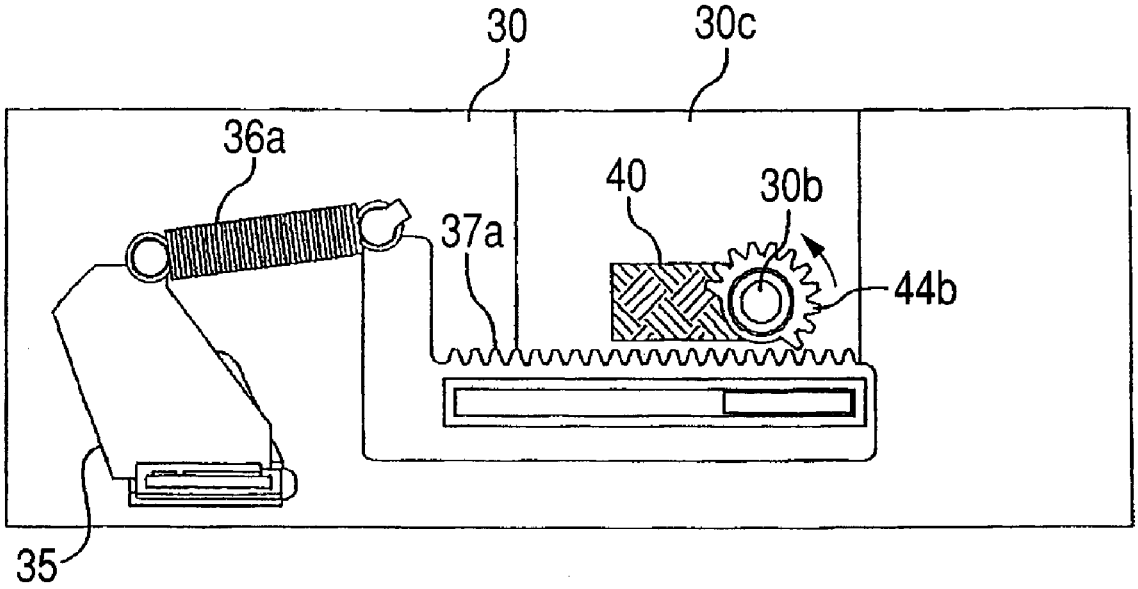
FIGS. 10A and 10B are diagrams for illustrating operations of the lifter driving mechanism and the setting mechanism.

When making a setting for large-size sheets, as illustrated in FIG. 9A, the cassette gear 44 is moved by the rear side regulating member 32*b* via the shift lever 40. The spur gear portion 44*a* is engaged with the second lifter rack 37*b* as a predetermined rack, and the partially toothless gear portion 44*b* is engaged with the first lifter rack 37*a* as a predetermined rack. When the sheet feeding cassette 30 is installed in the printer main body 101 by the user and the lift-up operation is started, the cassette gear 44 applied with a driving force transmitted by the driving force transmission gear 23 starts rotating, and the second lifter rack 37*b* engaged with the spur gear portion 44*a* first starts moving to the left in the drawing. At this time, the partially toothless gear portion 44*b* of the cassette gear 44 is not engaged with the first lifter rack 37*a* as illustrated in FIG. 10A, which is a sectional view taken along the line 10A-10A of FIG. 9A.

Figure 10B:
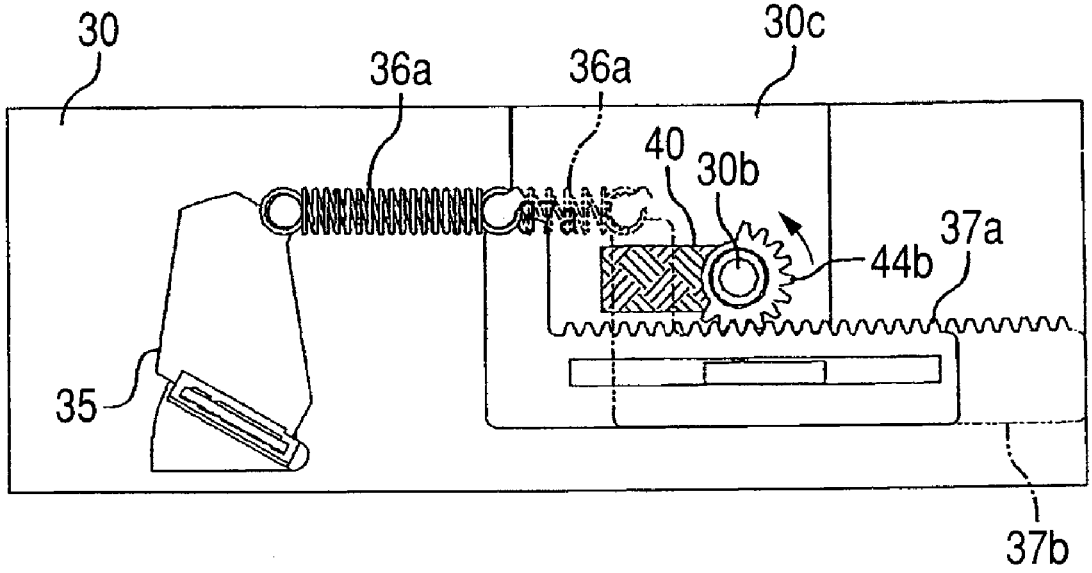
Figure 11:
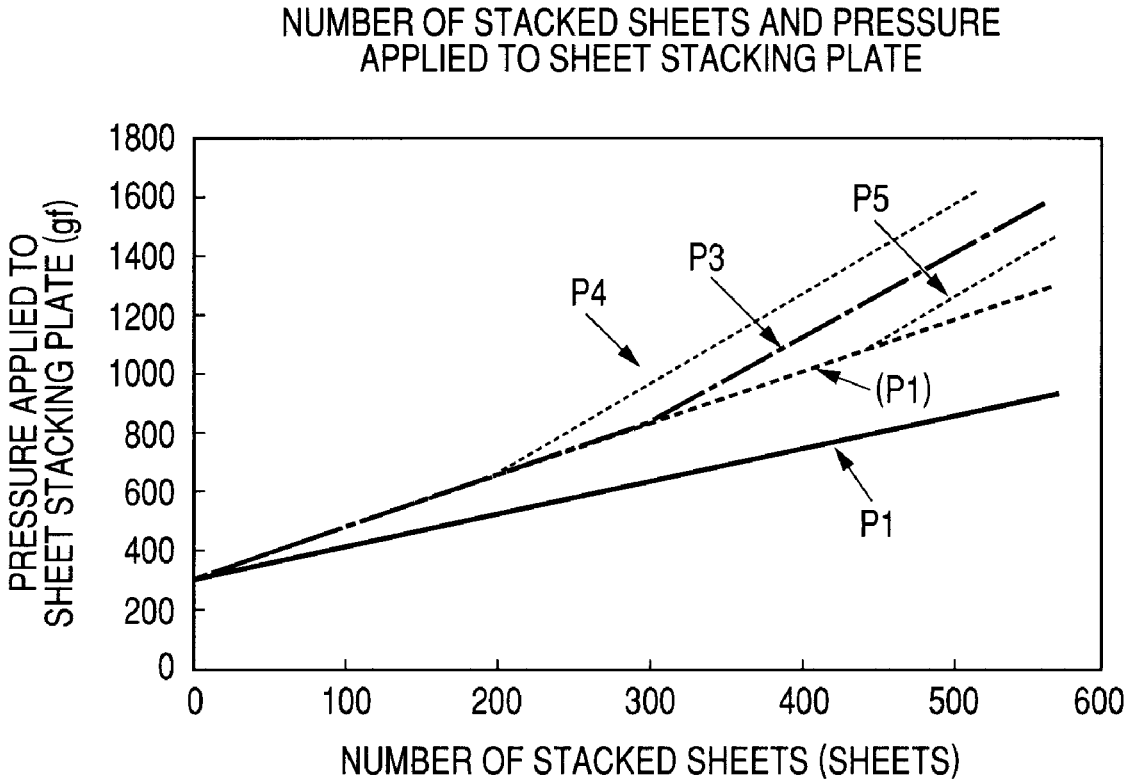
FIG. 11 is a graph illustrating a relation between the number of stacked sheets and the pressing force applied to the sheet stacking plate according to another configuration of the setting mechanism.

When the rotation of the cassette gear 44 reaches a predetermined amount, the tooth portion of the partially toothless gear portion 44*b* starts to engage with the first lifter rack 37*a*, to thereby move the first lifter rack 37*a* to the left in the drawing. When the rotation of the driving force transmission gear 23 reaches a predetermined amount, the driving force transmission gear 23 stops. As a result, as illustrated in FIG. 9B and FIG. 10B, which is a sectional view taken along the line 10B-10B of FIG. 9B, the first lifter rack 37*a* stops as being displaced with respect to the second lifter rack 37*b* by a predetermined distance. The phase of the partially toothless gear portion 44*b* is set so that the first lifter rack 37*a* stops at a position where the first pressure spring 36*a* exerts a spring pressure when the amount of stacked sheets is in a half-stacked state to a full-stacked state. With this configuration, in addition to the pressing force which is constantly applied by the second pressure spring 36*b*, an additional pressing force is applied by the first pressure spring 36*a* when the amount of stacked sheet is in a half-stacked state to a full-stacked state. As a result, as illustrated in FIG. 11, a pressing force of P3 is applied to the sheet stacking plate 31 when making a setting for large-size sheets. Even in a case where the sheet feeding pressure suffers a loss in a half-stacked to a full-stacked state when making a setting for large-size sheets, the loss may be compensated. In this embodiment, the first pressure spring 36*a* and the second pressure spring 36*b* may have spring constants which are set to be the same as each other or different from each other.

As described above, in this embodiment, the cassette gear 44 is provided with the partially toothless gear portion 44*b*. The partially toothless gear portion 44*b* causes the first pressure spring 36*a* to function from the half-stacked state to the full-stacked state, to thereby compensate a loss in the sheet feeding pressure which decreases from the half-stacked state to the full-stacked state. In other words, in this embodiment, multiple elastic members are caused to function in combination. With this configuration, the sheet feeding pressure may be increased when the number of sheets stacked on the sheet stacking plate 31 is equal to or larger than a predetermined amount, so that a substantially constant sheet feeding pressure may be applied even if the amount of stacked sheets is changed. In other words, in a case where large-size (portrait A4-size) sheets are set, a loss in the sheet feeding pressure may be compensated in view of the case as illustrated in a graph of FIG. 23 in which a loss in the sheet feeding pressure starts being generated on the way of increasing the amount of stacked sheets. In the less-stacked state, an unnecessary sheet feeding pressure is not applied, and hence a substantially constant sheet feeding pressure may be applied from a less-stacked state to a fully-stacked state, to thereby provide stable sheet feeding performance. The loss in the sheet feeding pressure may vary depending on the surface roughness of a sliding surface of the sheet feeding cassette 30 or the area of the sheet stacking plate 31. Accordingly, the pressure spring 36*a* which supplementarily functions may not necessarily be caused to function at a timing described in the above. The partially toothless gear portion 44*b* of the cassette gear 44 may be changed in phase according to the surface roughness of the sliding surface of the sheet feeding cassette 30 or the like, to thereby arbitrarily set the sheet feeding pressure to, for example, P4 or P5 illustrated in FIG. 11.

Figure 12:
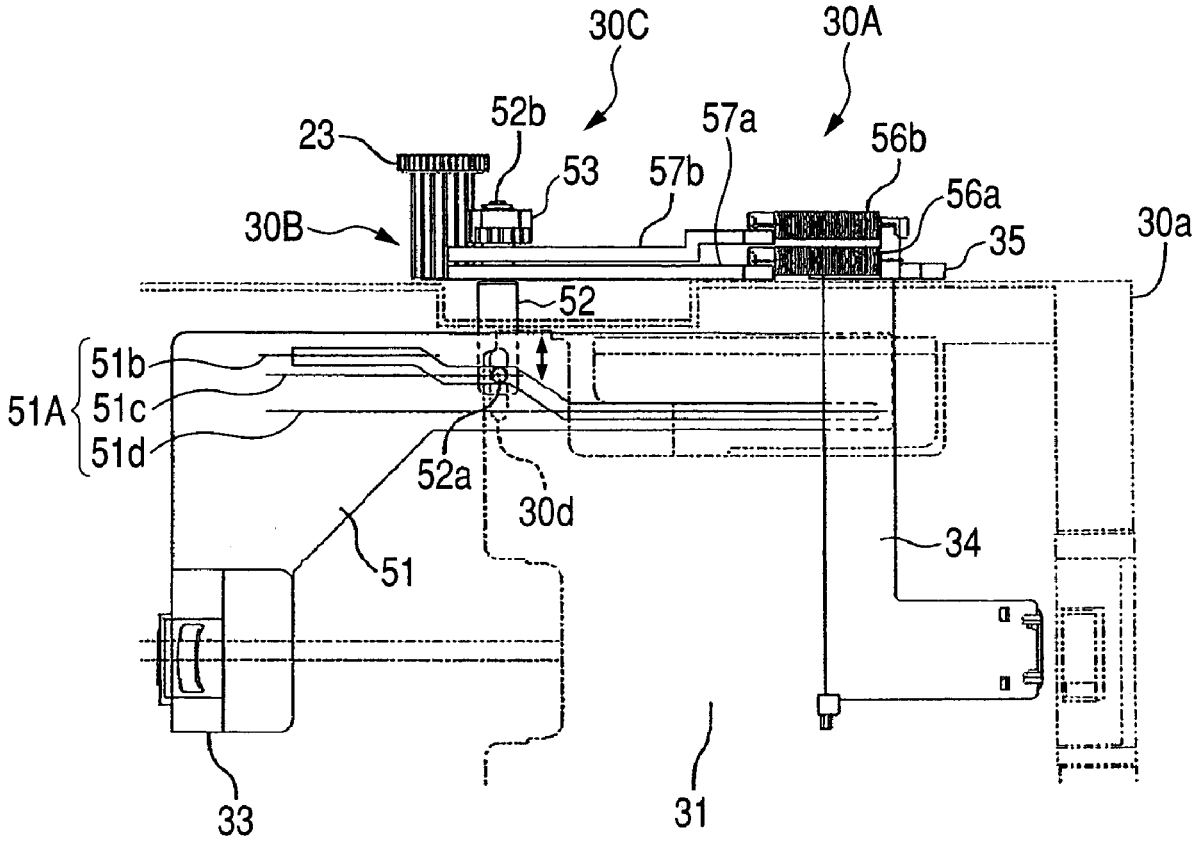
FIG. 12 is a top view for illustrating configurations of a lifter driving mechanism and a setting mechanism provided to an image forming apparatus according to a third embodiment of the present invention.
Figure 13:
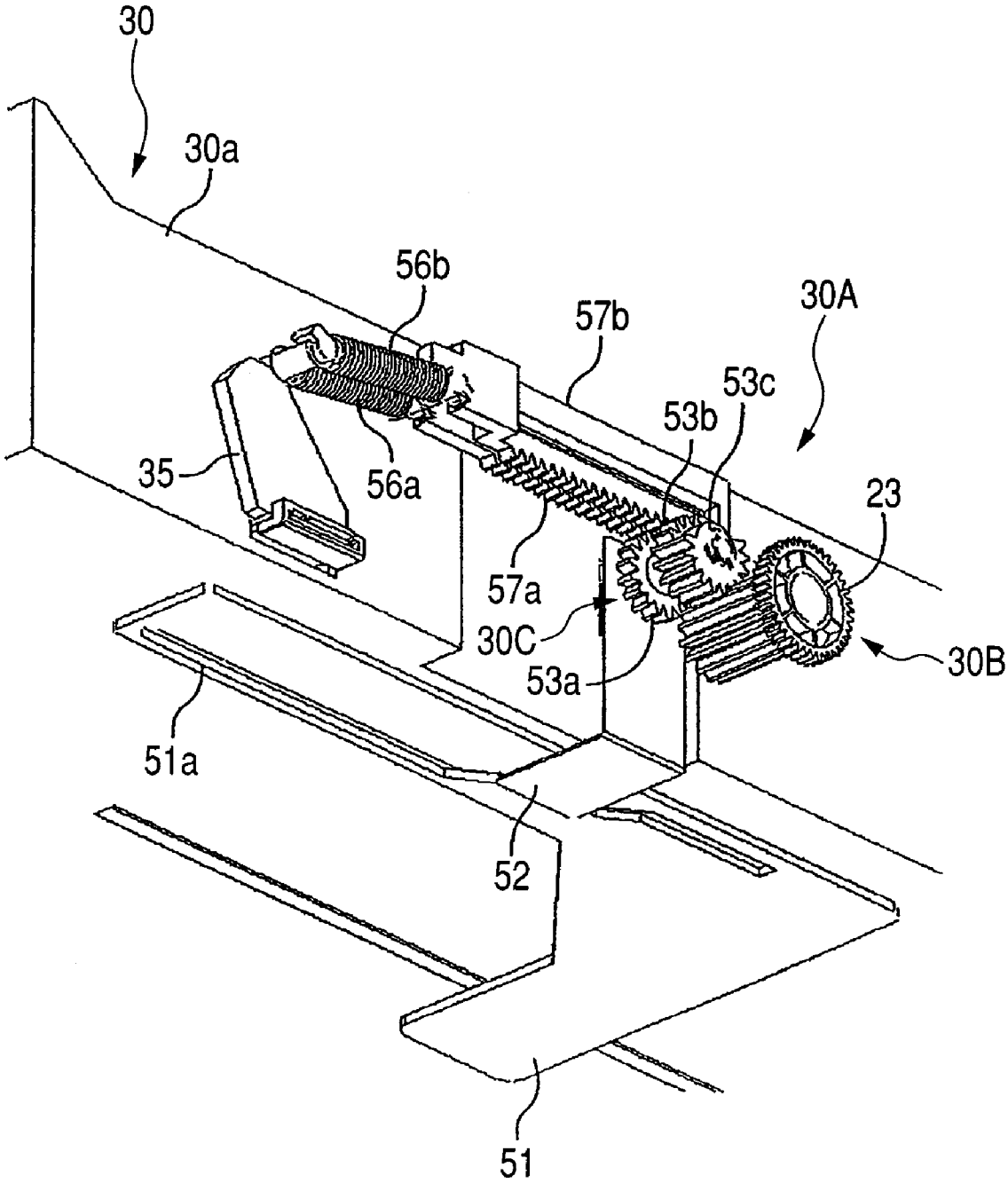
FIG. 13 is a rear perspective view for illustrating the configurations of the lifter driving mechanism and the setting mechanism provided to the sheet feeding cassette according to the third embodiment.

A third embodiment of the present invention is described. FIG. 12 is a top view for illustrating configurations of a lifter driving mechanism and a setting mechanism provided to a sheet feeding cassette of an image forming apparatus according to the embodiment. In FIG. 12, portions being the same as or corresponding to those of FIG. 2 are denoted by the same reference symbols. In FIG. 12, a pin 52*a* is protrudingly formed on a lower surface at an edge portion on the cassette main body, of a gear bracket 52. A sliding groove 30*d* formed in a bottom surface of the cassette main body 30*a*, and extends in the width direction. The pin 52*a* is engaged with the sliding groove 30*d*, so as to allow the gear bracket 52 to be slid in the width direction. A shift cam 51 is connected to the trailing edge regulating member 33, and provided with a guide groove portion 51A which includes, for example, three guide grooves 51*b* to 51*d* arranged in lines extending in the sheet feeding direction. The pin 52*a* of the gear bracket 52 is selectively engaged with one of the three guide grooves 51*b* to 51*d* of the guide groove portion 51A, in association with the movement of the trailing edge regulating member 33, which moves to a trailing edge regulating position corresponding to the size of sheets to be stored. The gear bracket 52 and the shift cam 51 are arranged, as illustrated in FIG. 13, to be overlaid on the bottom surface of the sheet feeding cassette 30. The gear bracket holding a cassette gear 53 slides along with the movement of the trailing edge regulating member 33, due to the shift cam 51.

Figure 14A:
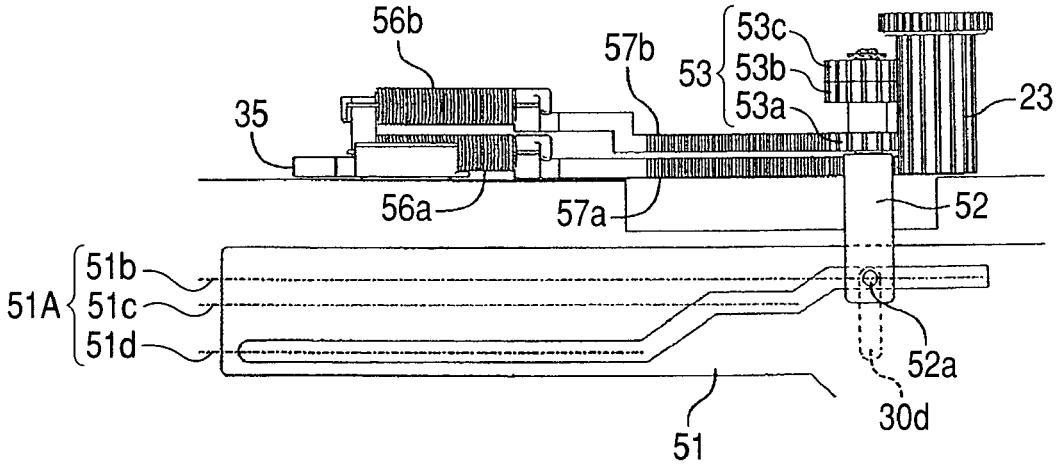
FIGS. 14A, 14B and 14C are diagrams for illustrating operations of the lifter driving mechanism and the setting mechanism.
Figure 14B:
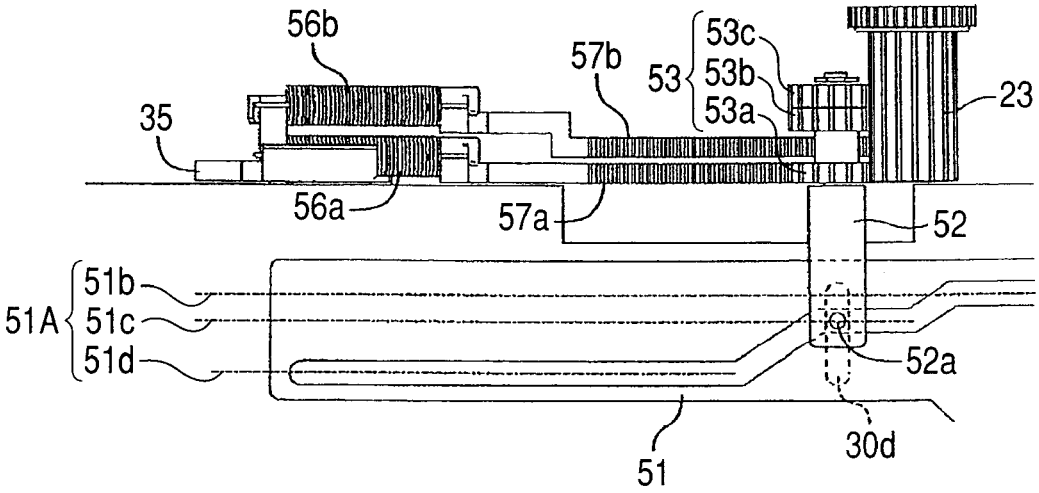
Figure 14C:
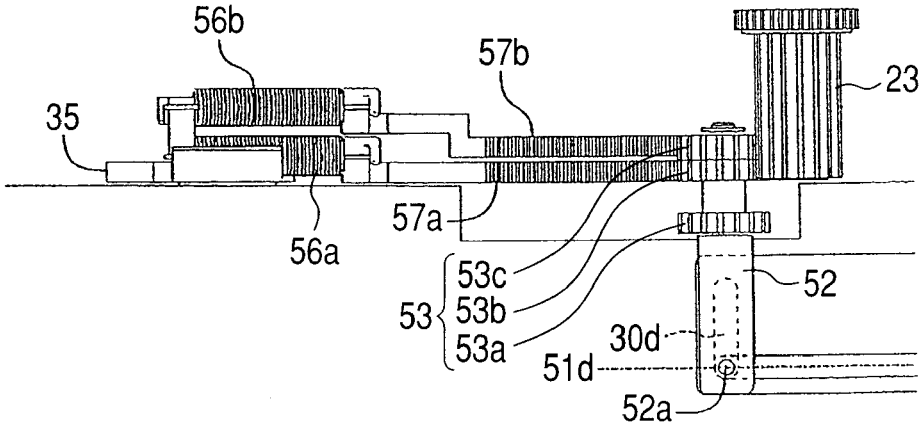

FIGS. 14A to 14C are diagrams for illustrating operations of the lifter driving mechanism and the setting mechanism, which is associated with the movement of the trailing edge regulating member 33 to a trailing edge regulating position. FIG. 14A illustrates a state of a setting made for portrait A5-size sheets, FIG. 14B illustrates a state of a setting made for portrait A4-size sheets, and FIG. 14C illustrates a state of a setting made for LGL-size sheets. In this embodiment, the cassette gear 53 has, in an axial direction, a first spur gear portion 53*a*, a partially toothless gear portion 53*c*, which are formed at a base end portion and a tip end portion, respectively, and a second spur gear portion 53*b* formed between the first spur gear portion 53*a* and the partially toothless gear portion 53*c*. The first spur gear portion 53*a*, the second spur gear portion 53*b*, and the partially toothless gear portion 53*c* are formed (arranged) in parallel with one another. When making a setting for portrait A5-size, the trailing edge regulating member 33 is moved to a trailing edge regulating position corresponding to the portrait A5-size, so that the shift cam 51 is moved. As a result, as illustrated in FIG. 14A, the pin 52*a* of the gear bracket 52 is engaged with the first guide groove 51*b* formed in the guide groove portion 51A of the shift cam 51. When the pin 52 is engaged with the first guide groove 51*b*, the pin 52*a* of the gear bracket 52 moves in the sliding groove 30*d* of the sheet feeding cassette 30 to a portion nearer to the outside of the sheet feeding cassette 30. When the pin 52*a* moves, the cassette gear 53 supported by the gear bracket 52 moves to a position where the first spur gear portion 53*a* is engaged with the second lifter rack 57*b*. In this state, the cassette gear 53 is applied with a driving force transmitted from the driving force transmission gear 23 and rotated, so that only the second lifter rack 57*b* moves to the right, to thereby cause the second pressure spring 56*b* to function. In this embodiment, a spring pressure set to the second pressure spring 56*d* is similar to that of the first pressure spring 36*a* of the first embodiment. The pressing force applied to the sheet stacking plate 31 is similar to that of the first embodiment, and a sheet feeding pressure appropriate for the portrait A5-size is applied to the sheet stacking plate 31.

When making a setting for portrait A4-size, the trailing edge regulating member 33 is moved to a trailing edge regulating position corresponding to the portrait A4-size, so that the pin 52*a* of the gear bracket 52 is engaged with the second guide groove 51*c* of the shift cam 51 as illustrated in FIG. 14B. As a result, the pin 52*a* of the gear bracket 52 moves to the center of the sliding groove 30*d* of the sheet feeding cassette 30. When the pin 52*a* moves, the gear bracket 52 moves inside the cassette main body 30*a*, so that the first spur gear portion 53*a* of the cassette gear 53 is engaged with the first lifter rack 57*a*. In this state, the cassette gear 53 is applied with a driving force transmitted from the driving force transmission gear 23 and rotated, so that only the first lifter rack 57*a* moves, to thereby cause the first pressure spring 56*a* to function. A spring pressure of the first pressure spring 56*a* is similar to that of the second pressure spring 36*b* of the first embodiment. Accordingly, the pressing force applied to the sheet stacking plate 31 is similar to that of the first embodiment, and a sheet feeding pressure appropriate for portrait A4-size sheets are provided to the sheet stacking plate 31.

Figure 23:
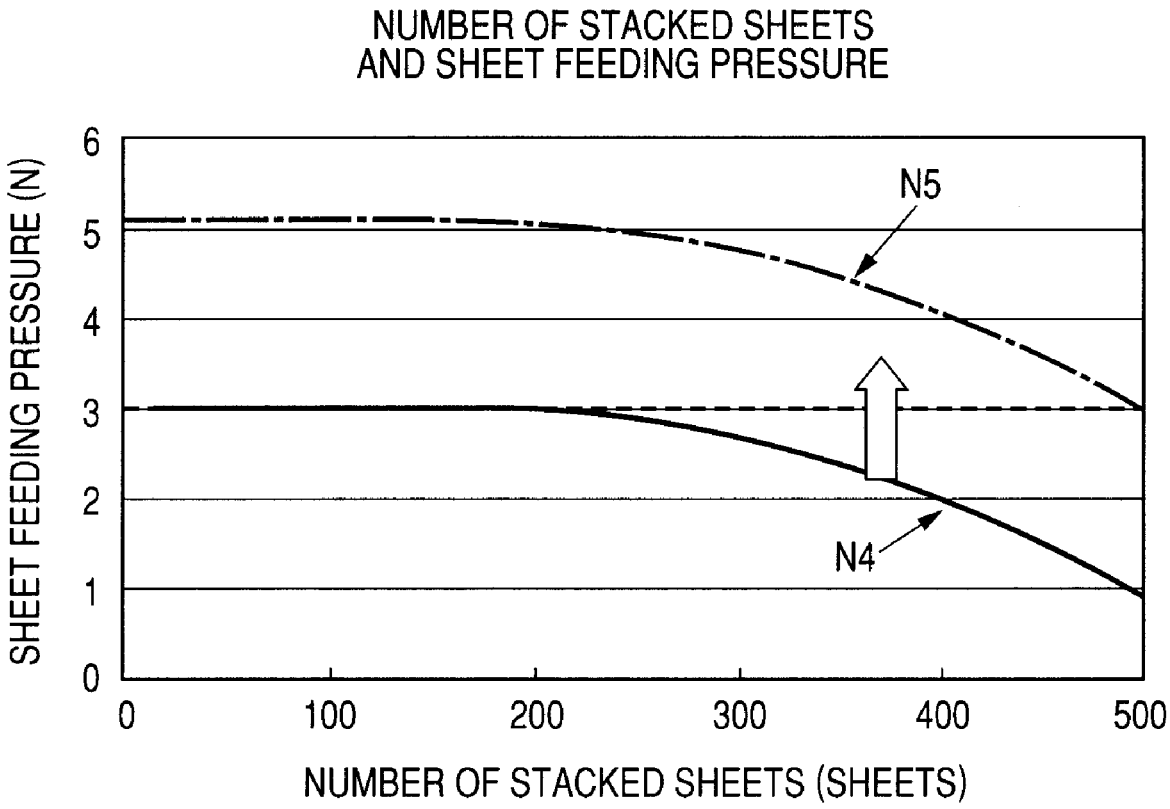
FIG. 23 is a graph illustrating a relation between the number of stacked sheets and a sheet feeding pressure.

When making a setting for LGL size, the trailing edge regulating member 33 is moved to a trailing edge regulating position corresponding to the LGL size, so that the pin 52*a* of the gear bracket 52 is engaged with the third guide groove 51*d* of the shift cam 51 as illustrated in FIG. 14C. As a result, the pin 52*a* of the gear bracket 52 moves along the sliding groove 30*d* of the sheet feeding cassette 30 to a portion nearer to the inside of the sheet feeding cassette 30. When the pin 52*a* moves, the gear bracket 52 moves further inside the cassette main body 30*a*. Here, in the case of LGL-size sheets, the sheet feeding pressure suffers a loss from a half-stacked state to a full-stacked state as illustrated in FIG. 23, and hence the sheet feeding pressure needs to be increased in an auxiliary manner from the half-stacked state to the full-stacked state.

In this embodiment, when the gear bracket 52 moves, the second spur gear portion 53*b* and the partially toothless gear portion 53*c* of the cassette gear 53 are each engaged with the first lifter rack 57*a* and the second lifter rack 57*b*, respectively. The partially toothless gear portion 53*c* is similar in specification and phase to the partially toothless gear portion 44*b* of the cassette gear 44 of the second embodiment illustrated in FIGS. 9A and 9B. Accordingly, the partially toothless gear portion 53*c* is engaged with the second lifter rack 57*b* at a timing later than a timing at which the second spur gear portion 53*b* moves the first lifter rack 57*a*. As a result, the cassette gear 53 applied with a driving force transmitted from the driving force transmission gear 23 is rotated, so that the first lifter rack 57*a* is moved first, and then the second lifter rack 57*b* is moved afterwards. After a predetermined time, the first lifter rack 57*a* and the second lifter rack 57*b* are stopped. The positional relation between the first lifter rack 57*a* and the second lifter rack 57*b* thus stopped is similar to the positional relation between the first lifter rack 36*a* and the second lifter rack 36*b* of the second embodiment illustrated in FIGS. 9B and 10B. Accordingly, the second pressure spring 56*b* extended due to the partially toothless gear portion 53*c* exerts a spring pressure when the amount of sheets is in the half-stacked state to the full-stacked state. The pressing force applied to the sheet stacking plate 31 at this time becomes equal to P3 of FIG. 11.

As described above, in this embodiment, the pressure springs 56*a* and 56*b* to be caused to function are switched therebetween, in association with the movement of the trailing edge regulating member 33, to thereby cause the pressure spring appropriate for the sheet size to function. With this configuration, similar to the first embodiment, a constant sheet feeding pressure is exerted from the full-stacked state to the less-stacked state. Similarly to the second embodiment, the partially toothless gear 53*c* is provided to the cassette gear 53, to thereby allow the second pressure spring 56*b* to function from the half-stacked state to the full-stacked state. From the half-stacked state to the full-stacked state, in which the number of stacked sheets exceeds a predetermined number of sheets, the number of pressure springs may be increased, to thereby compensate the loss in the sheet feeding pressure which decreases from the half-stacked state to the full-stacked state. According to the configuration of this embodiment, the sheet feeding cassette supporting portrait A5-size sheets up to LGL-size sheets, which are elongated sheets, is described. However, the present invention is not limited thereto, and may be applied to a large sheet feeding cassette supporting A3-size sheets to obtain the same effect.

Figure 15:
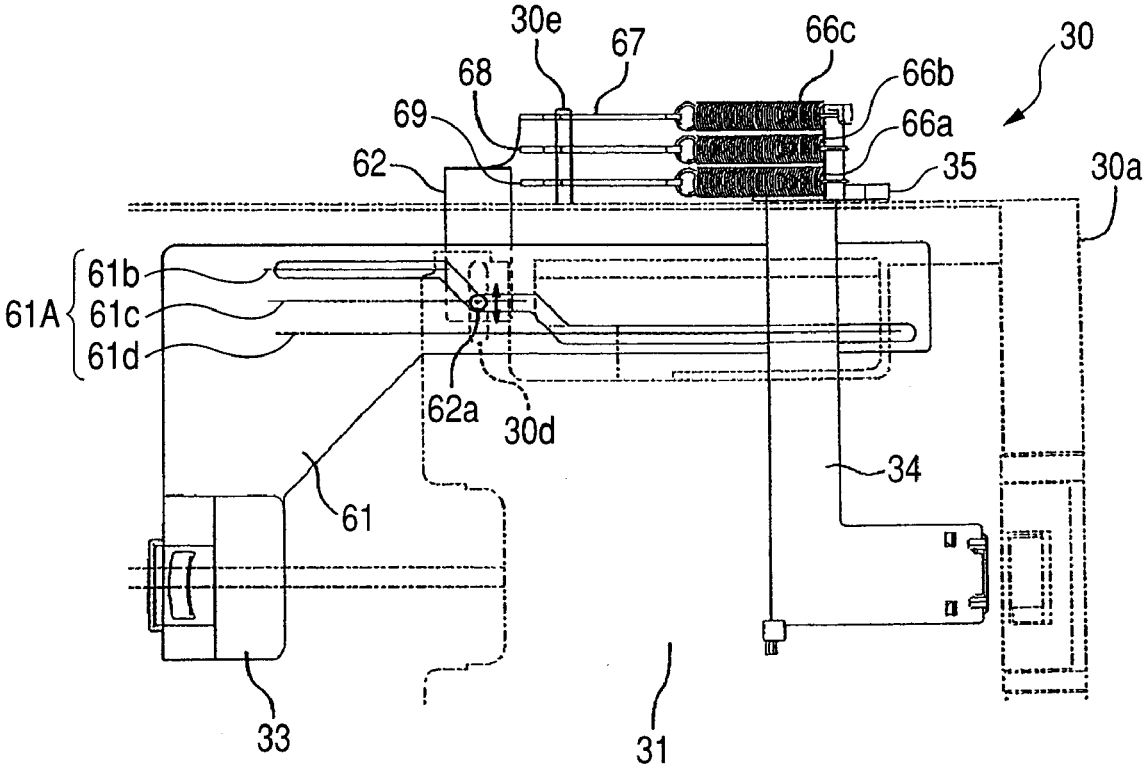
FIG. 15 is a top view for illustrating configurations of a lifter driving mechanism and a setting mechanism provided to an image forming apparatus according to a fourth embodiment of the present invention.
Figure 16:
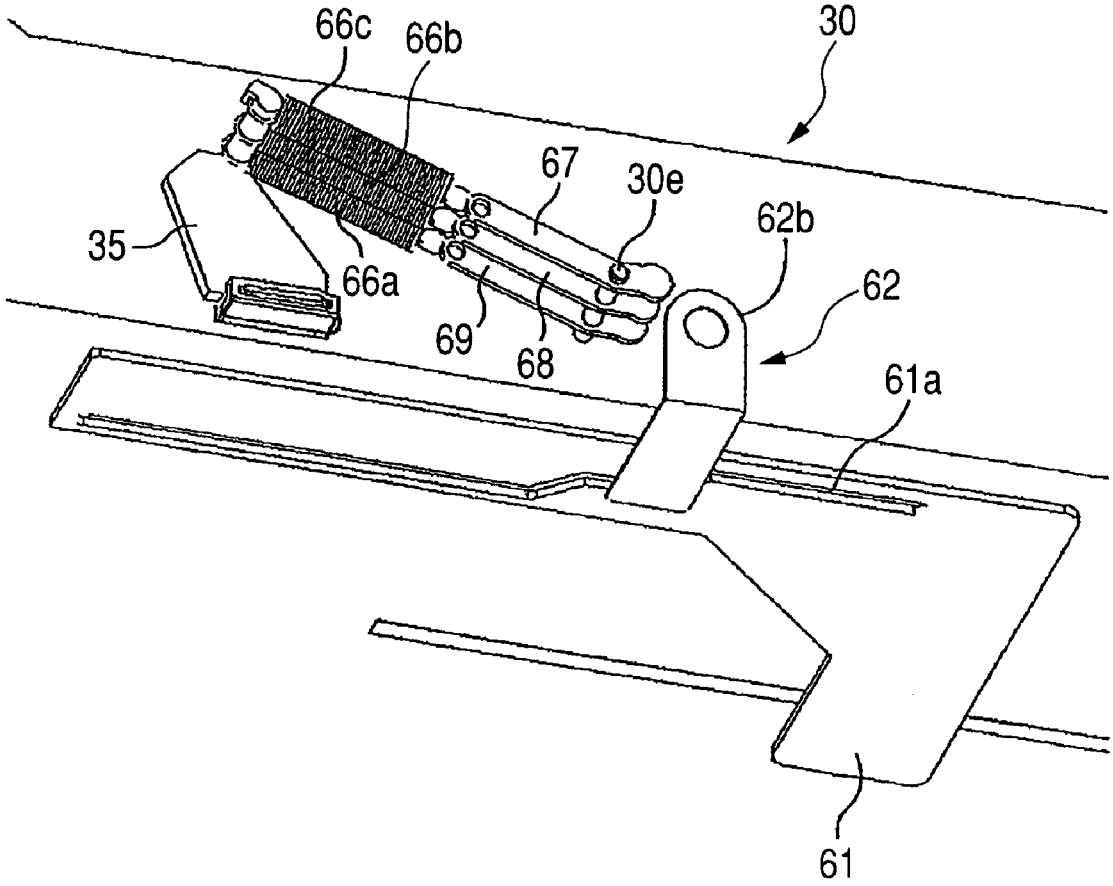
FIG. 16 is a rear perspective view for illustrating the configurations of the lifter driving mechanism and the setting mechanism.

A fourth embodiment of the present invention is described. FIG. 15 is a top view for illustrating configurations of a lifter driving mechanism and a setting mechanism provided to an image forming apparatus according to the embodiment. In FIG. 15, portions being the same as or corresponding to those of FIG. 2 are denoted by the same reference symbols. In FIG. 15, a first pull lever 67, a second pull lever 68, and a third pull lever 69 are provided independently of each other, and are supported so as to be rockable around a fulcrum shaft 30*e* provided on a depth side surface of the sheet feeding cassette 30. The first to third pull levers 67 to 69 are connected to ends of three pressure springs 66*a* to 66*c*, respectively. Other ends of the three pressure springs 66*a* to 66*c* are connected to the pressing arm 35. In FIG. 15, a gear bracket 62 is provided on a lower surface of the sheet feeding cassette 30. The gear bracket 62 has a pin 62*a* protrudingly formed on a lower surface at the edge portion on the cassette main body side of the gear bracket 62. The pin 62*a* is engaged with the sliding groove 30*d*, so as to allow the gear bracket 62 to be slid in the width direction. The gear bracket 62 has a tip end thereof bent vertically to be formed into a pressing portion 62*b* as illustrated in FIG. 16.

In FIG. 15, a shift cam 61 is connected to the trailing edge regulating member 33, and provided with a guide groove portion 61A which includes, for example, three guide grooves 61*b* to 61*d* arranged in lines extending in the sheet feeding direction. The pin 62*a* of the gear bracket 62 is selectively engaged with one of the three guide grooves 61*b* to 61*d* of the guide groove portion 61A, in association with the movement of the trailing edge regulating member 33, which moves to a trailing edge regulating position corresponding to the size of sheets to be stored. The gear bracket 62 and the shift cam 61 are arranged, as illustrated in FIG. 16, to be overlaid on the bottom surface of the sheet feeding cassette 30. The gear bracket 62 slides along with the movement of the trailing edge regulating member 33, due to the shift cam 61.

Figure 17:
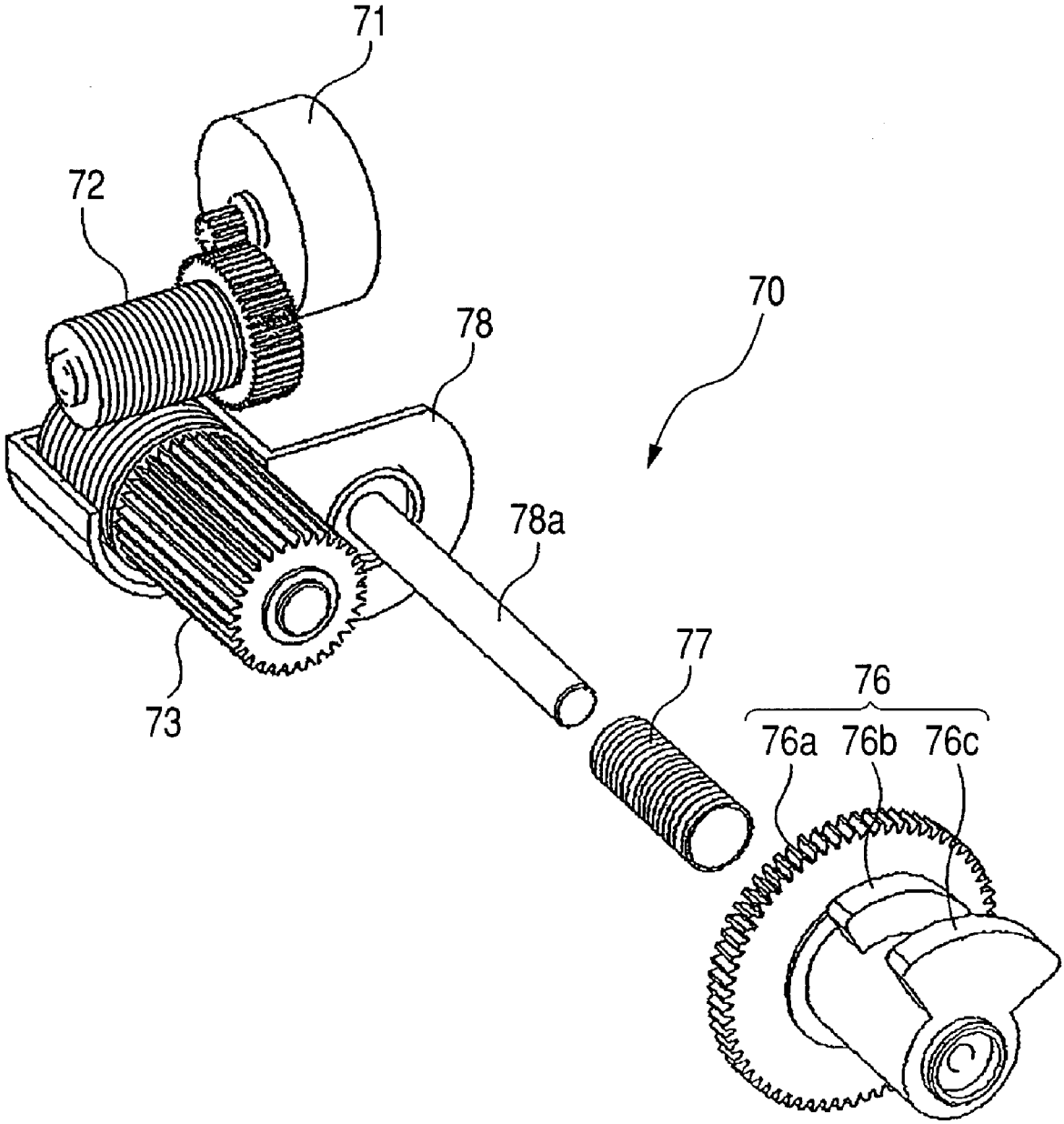
FIG. 17 is a diagram for illustrating a configuration of a gear box unit of the lifter driving mechanism.

In this embodiment, a drive source of the lifter driving mechanism is provided to the printer main body side. FIG. 17 is a diagram for illustrating a configuration of a gear box unit 70 which is provided on the printer main body and serves as the drive source of the lifter driving mechanism. The gear box unit 70 includes a motor 71, a worm gear 72 rotated by the motor 71, an idle gear 73 as a rotor to be rotated by the worm gear 72, and a driving force transmission gear 76 which meshes with the idle gear 73 to be rotated. The driving force transmission gear 76 is supported so as to be rotatable around an axis 78*a* of the gear box 78 across a compression coil spring 77 and slidable along the axis 78*a*, and includes a spur gear portion 76*a*, a small-diameter cam portion 76*b*, and a large-diameter cam portion 76*c*, which are provided to have a predetermined phase relation therebetween.

Figure 18A:
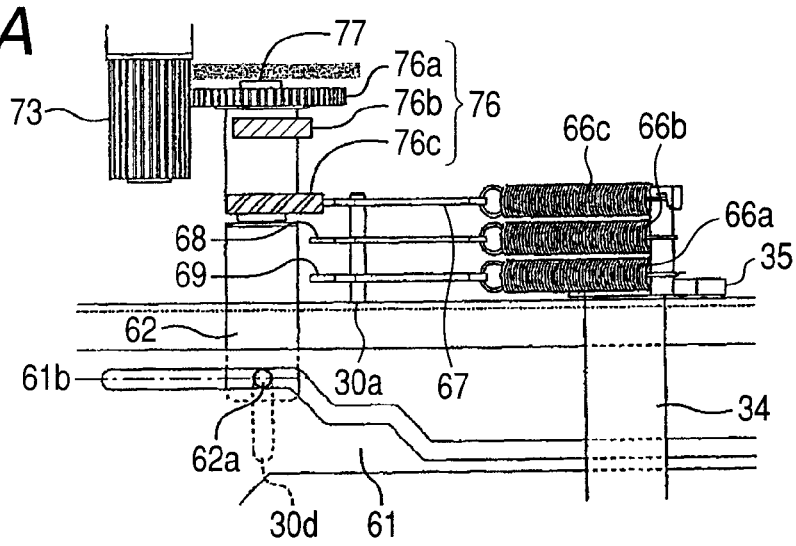
FIGS. 18A, 18B and 18C are first diagrams for illustrating operations of the lifter driving mechanism and the setting mechanism.

For example, when making a setting for portrait A5-size, the trailing edge regulating member 33 is moved to a trailing edge regulating position corresponding to the portrait A5-size. Along with the movement of the trailing edge regulating member 33, the pin 62*a* of the gear bracket 62 illustrated in FIG. 15 is engaged with the first guide groove 61*b* of the guide groove portion 61A in the shift cam 61. When the pin 62*a* is engaged with the first guide groove 61*b*, the pin 62*a* of the gear bracket 62 moves along the sliding groove 30*d* of the sheet feeding cassette 30 to a portion nearer to the outside of the sheet feeding cassette 30. When the pin 62*a* is thus moved, the gear bracket 62 is slid outside to be most displaced outward from the sheet feeding cassette 30. When the sheet feeding cassette 30 set for the portrait A5-size is installed in the printer main body 101, the pressing portion 62*b* (see FIG. 16) of the gear bracket 62 thus displaced comes into contact with an edge surface of the driving force transmission gear 76. After that, the sheet feeding cassette 30 is further pushed, so that the driving force transmission gear 76 is pushed against the spring pressure of the compression coil spring 77, into a position illustrated in FIG. 18A. As a result, the large-diameter cam portion 76*c* of the driving force transmission gear 76 is arranged to be in the same phase with the first pull lever 67.

Figure 19A:
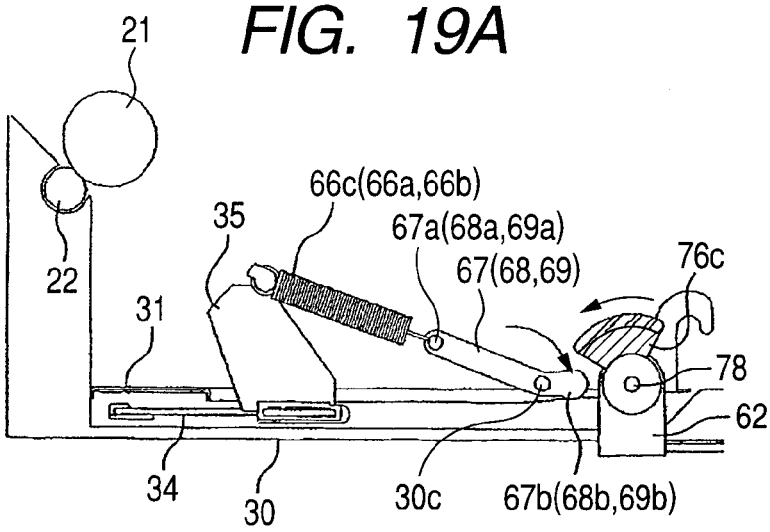
FIGS. 19A, 19B and 19C are second diagrams for illustrating operations of the lifter driving mechanism and the setting mechanism.

After that, as illustrated in FIG. 19A, the driving force transmission gear 76 rotates in a counterclockwise direction, so that the large-diameter cam portion 76*c* of the driving force transmission gear 76 abuts on a pressing point 67*b* of the first pull lever 67, to thereby cause the first pull lever 67 to rock around the fulcrum shaft 30*c* in a clockwise direction. At this time, the first pull lever 67 pulls the first pressure spring 66*c* connected to a spring catch portion 67*a* of the first pull lever 67, and starts pushing up the sheet stacking plate 31 via the pressing arm 35 and the pressing lever 34 simultaneously. After that, the driving gear 76 is stopped after being rotated until the pressing point 67*b* of the first pull lever 67 is placed on an outer surface of the large-diameter cam portion 76*c*, to thereby complete the lift-up operation of the sheet stacking plate 31. The first pressure spring 66*c* is set similarly to the first pressure spring 36*a* in the first embodiment, in terms of spring constant and acting length. Accordingly, the pressing force to be applied on the sheet stacking plate 31 becomes equal to P1 of FIG. 4A.

Figure 18B:
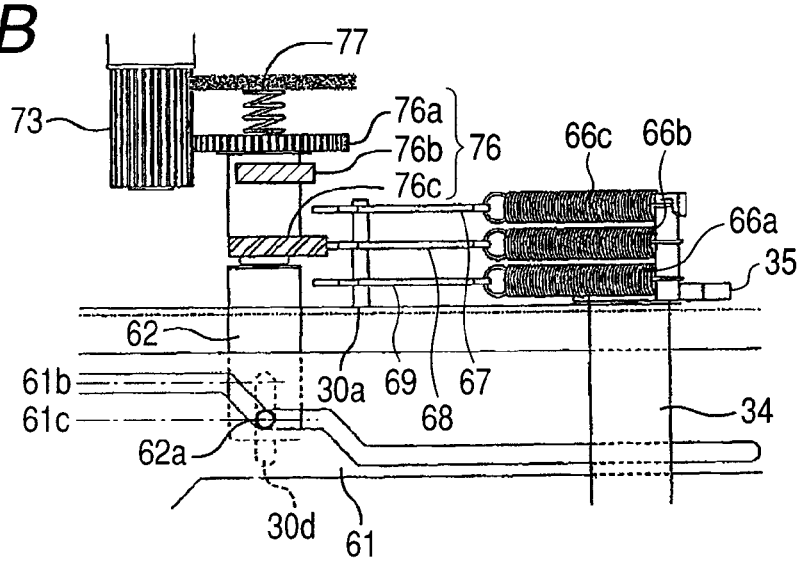

When making a setting for portrait A4-size, the trailing edge regulating member 33 is moved to a trailing edge regulating position corresponding to the portrait A4-size. Along with the movement of the trailing edge regulating member 33, the pin 62*a* of the gear bracket 62 is engaged with the second guide groove 61*c* of the guide groove portion 61A in the shift cam 61 as illustrated in FIG. 15. When the pin 62*a* is engaged with the second guide groove 61*c*, the pin 62*a* of the gear bracket 62 moves to the center of the sliding groove 30*d* of the sheet feeding cassette 30. When the pin 62*a* is thus moved, the gear bracket 62 is slid inside the cassette main body 30*a*. After that, the sheet feeding cassette 30 set for the portrait A4-size is installed in the printer main body 101, so that the driving force transmission gear 76 is pushed by the gear bracket 62 into a position illustrated in FIG. 18B. In this state, the large-diameter cam portion 76*c* of the driving force transmission gear 76 is arranged to be in the same phase with the second pull lever 68. The lift-up operation is similarly performed from this state as in the above-mentioned case of making a setting for portrait A5-size, and hence the description thereof is omitted. The second pressure spring 66*b* to function after the completion of the lift-up operation is set similarly to the second pressure spring 36*b* in the first embodiment, in terms of spring constant and acting length. Accordingly, the pressing force to be applied on the sheet stacking plate 31 becomes equal to P2 of FIG. 4A.

Figure 18C:
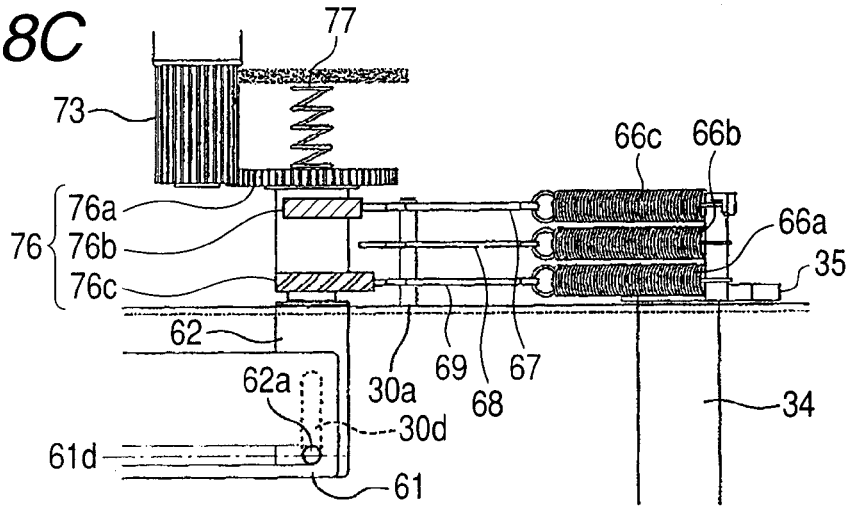
Figure 19B:
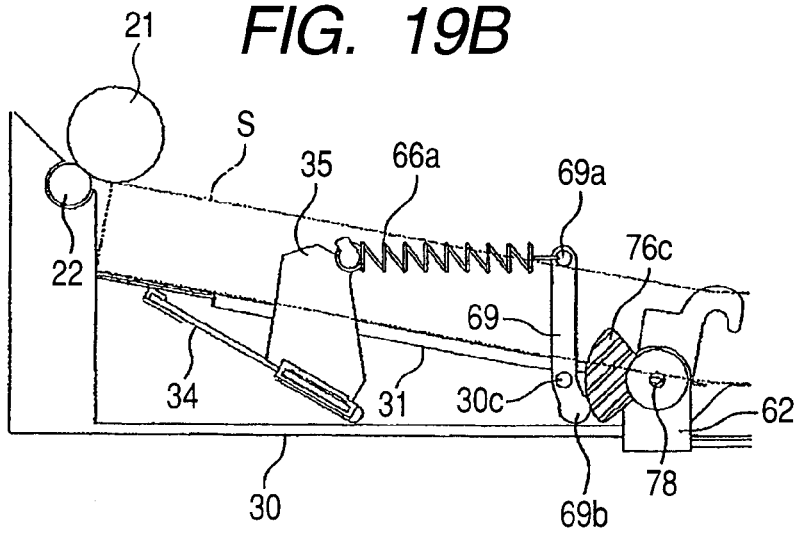

When making a setting for LGL size, the trailing edge regulating member 33 is moved to a trailing edge regulating position corresponding to the LGL size. By the action of the pin 62*a* of the gear bracket 62 and the third guide groove 61*d* in the shift cam 61, the gear bracket 62 is slid inward to a position most retracted into the sheet feeding cassette 30 side. In this state, when the sheet feeding cassette 30 is installed in the printer main body 101, the large-diameter cam portion 76*c* of the driving force transmission gear 76 is arranged to be in the same phase with the third pull lever 69 and the small-diameter cam portion 76*b* is arranged to be in the same phase with the first pull lever 67, as illustrated in FIG. 18C. After that, the driving force transmission gear 76 rotates in a counterclockwise direction, so that the large-diameter cam portion 76*c* and the small-diameter cam portion 76*b* of the driving force transmission gear 76 abut on a pressing point 69*b* of the third pull lever 69 and on the pressing point 67*b* of the first pull lever 67, respectively. After that, the driving force transmission gear 76 is further rotated, to thereby cause the third pull lever 69 to rock around the fulcrum shaft 30*c* in a clockwise direction, as illustrated in FIG. 19B. The third pull lever 69 engaged with the large-diameter cam portion 76*c* operates as described above, and hence the description thereof is omitted. The first pressure spring 66*a* connected to the third pull lever 69 is similar to the second pressure spring 66*b*. Accordingly, the pressing force to be applied on the sheet stacking plate 31 becomes equal to P2 of FIG. 4A.

Figure 19C:
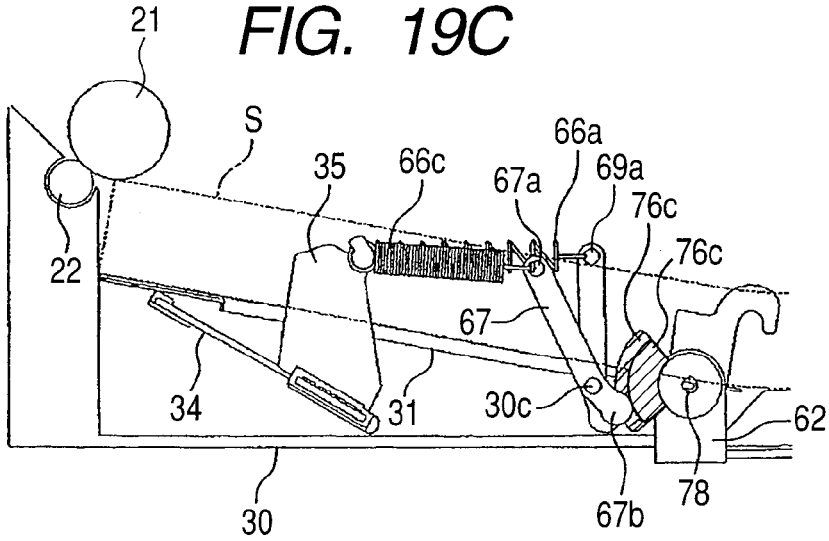

When the lift-up operation is completed, the first pull lever 67 engaged with the small-diameter cam portion 76*b* stops in a state where the pressing point 67*b* is in abutment with the outer surface of the small-diameter cam portion 76*b*. The outer surface of the small-diameter cam portion 76*b* is slightly smaller than that of the large-diameter cam portion 76*c*, and hence, as illustrated in FIG. 19C, the first pull lever 67 is held at a position after being rotated by a smaller amount than the third pull lever 69 rotated by the large-diameter cam portion 76*c*. An acting length of the third pressure spring 66*c* connected to the first pull lever 67 and a radius of the outer surface of the small-diameter cam portion 76*b* are adjusted so that the spring pressure is exerted from the half-stacked stated to the full-stacked state. Accordingly, the pressing force applied to the sheet stacking plate 31 by the first pressure spring 66*a* and the third pressure spring 66*c*, which function when a setting for LGL size is made, becomes equal to P3 of FIG. 11, similarly to the second and third embodiments.

As described above, the present invention may also be applied even to a case where the drive source of the lifter driving mechanism is provided separately from the printer main body as in this embodiment. The radius of the outer surface of the small-diameter cam portion 76*b* may be adjusted, to thereby change arbitrarily the timing to start extending the third pressure spring 66*c* so that a pressing force such as P4 or P5 of FIG. 11 may be selectively exerted, similarly to the second embodiment.

Figure 20:
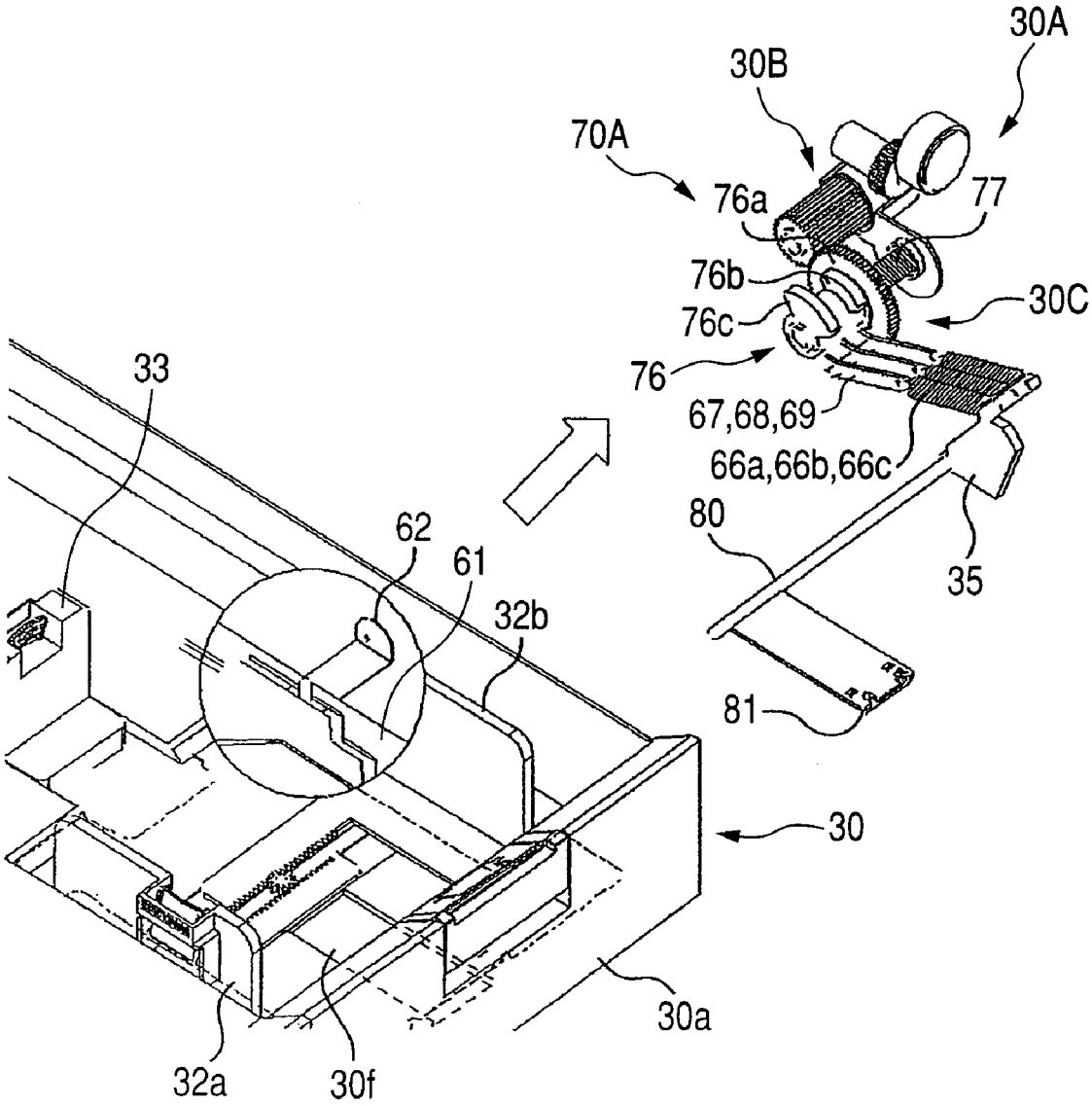
FIG. 20 is a diagram for illustrating configurations of a lifter driving mechanism and a setting mechanism provided to an image forming apparatus according to a fifth embodiment of the present invention.
Figure 21:
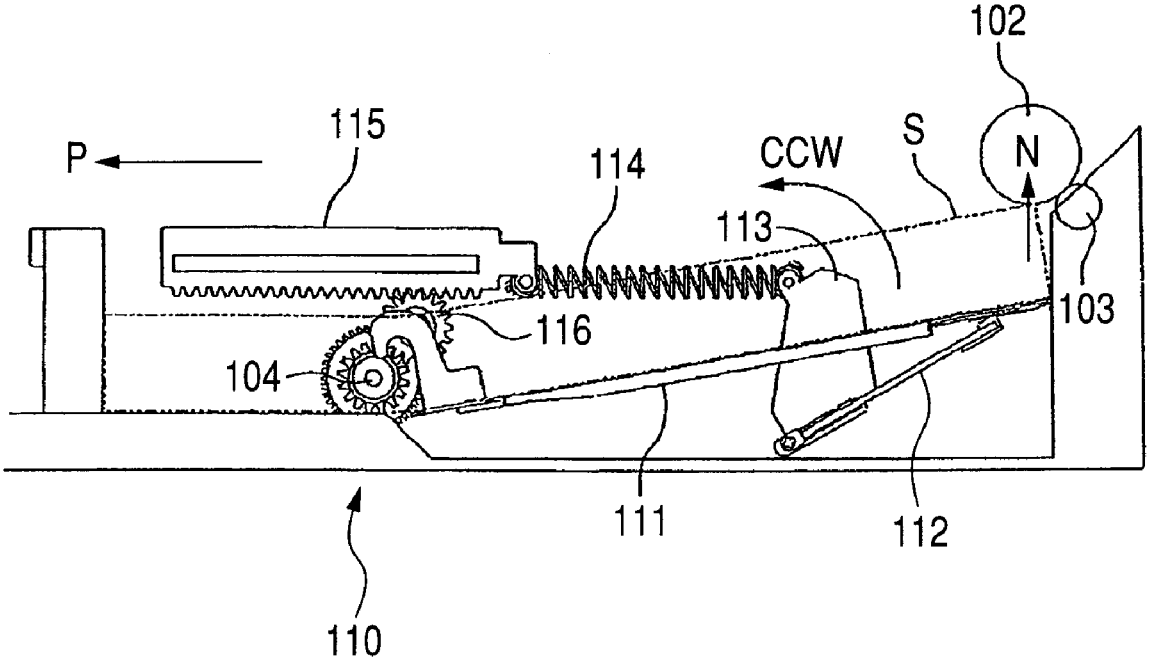
FIG. 21 is a diagram for illustrating an example of a conventional lifter driving mechanism.

A fifth embodiment of the present invention is described. FIG. 20 is a diagram for illustrating configurations of a lifter driving mechanism and a setting mechanism provided to an image forming apparatus according to this embodiment, and illustrates how the sheet feeding cassette 30 is installed in the printer main body 101. In FIG. 20, portions being the same as or corresponding to those of FIG. 2 are denoted by the same reference symbols.

In FIG. 20, a motor gear unit 70A is similar to the gear box unit 70 of the fourth embodiment, and is provided to the printer main body 101 in this embodiment. A setting mechanism 30B is also provided to the printer main body 101, and the pressing arm 35 has a pressing lever 81 connected thereto via a pressing arm axis 80. In this embodiment, a lifter driving mechanism 30A and a setting mechanism 30B of the sheet stacking plate 31 are provided to the printer main body 101. When the sheet feeding cassette 30 is installed in the printer main body 101, the pressing arm axis 80 and the pressing lever 81 is disposed below the cassette main body 30*a*. Similarly to the fourth embodiment, the sheet feeding cassette 30 is provided with the shift cam 61 and the gear bracket 62. The shift cam 61 moves in association with the trailing edge regulating member 33, and causes the gear bracket 62 to slide. Similarly to the fourth embodiment, the amount of displacement of the gear bracket 62 varies according to the position of the trailing edge regulating member 33. When the sheet feeding cassette 30 is installed in the printer main body 101, the position of the driving force transmission gear 76 varies according to the amount of displacement of the gear bracket 62, and the pull levers 67 to 69, which are in the same phase with the large-diameter cam portion 76*c* or with the small-diameter cam portion 76*b*, are caused to function. The lift-up operation and the sheet feeding pressure to be exerted onto the sheet stacking plate 31 are similar to those of the fourth embodiment, and hence the description thereof is omitted.

In this embodiment, an opening portion 30*f* is formed in a bottom surface of the cassette main body 30*a* in a portion facing the sheet stacking plate 31. When the sheet feeding cassette is installed in the printer main body 101, the opening portion 30*f* is positioned above the pressing lever 81. With this configuration, when the pressing lever 81 turns during the lift-up operation, the pressing lever 81 passes through the opening portion 30*f* to abut on the rear surface of the sheet stacking plate 31, to thereby push up the sheet stacking plate 31. As described above, even in a case where the pressing mechanism for the sheet stacking plate 31 is provided to the printer main body 101 as in this embodiment, an appropriate pressure spring may be selected according to the sheet size, to thereby apply a substantially constant sheet feeding pressure regardless of the amount of stacked sheets.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-179911, filed Jul. 31, 2009, which is hereby incorporated by reference herein in its entirety.

What is claimed is:

1. An image forming apparatus including a sheet feeding cassette which is provided to an apparatus main body and provided with a sheet stacking portion configured to stack sheets thereon, the sheet stacking portion being liftable for a cassette main body, and a sheet feeding portion configured to feed the sheets to be stacked, the image forming apparatus comprising:

a lift member configured to push up the sheet stacking portion so that the sheets to be stacked are brought into pressure contact with the sheet feeding portion;

a plurality of springs coupled to the lift member, which are set to have one of the same spring constant and spring constants different from each other;

a driving mechanism configured to drive the lift member; and a setting mechanism disposed between the lift member and the driving mechanism, and setting a pressure contact force for bringing the sheet to be stacked into pressure contact with the sheet feeding portion by selectively causing the plurality of springs to function with respect to the lift member according to a size of the sheets to be stacked.

2. An image forming apparatus according to claim 1, wherein the setting mechanism comprises:

a plurality of racks arranged in parallel with one another as being engaged with one ends of the plurality of springs, the plurality of racks being movable in a direction of causing the plurality of springs to function; and a pinion which is movable in a direction orthogonal to a moving direction of the plurality of racks, is moved to engage with a predetermined rack of the plurality of racks according to a size of the sheets to be stacked, and is rotated by the driving mechanism to move the predetermined rack.

3. An image forming apparatus according to claim 1, wherein the setting mechanism has a function of selectively causing the plurality of springs to function with respect to the lift member and a function of causing the plurality of springs to function simultaneously with respect to the lift member, according to a size of the sheets to be stacked.

4. An image forming apparatus according to claim 1, wherein:

the sheet feeding cassette includes a regulating member for regulating a position of the sheets to be stacked, the regulating member being movable; and the setting mechanism selects, from among the plurality of springs, a spring to function with respect to the lift member depending on the position regulated by the regulating member according to a size of the sheets to be stacked.

* * * * *